US010928092B2

(12) United States Patent
Yajima et al.

(10) Patent No.: US 10,928,092 B2
(45) Date of Patent: Feb. 23, 2021

(54) USAGE-SIDE AIR-CONDITIONING APPARATUS AND AIR-CONDITIONING APPARATUS PROVIDED WITH SAME

(71) Applicant: DAIKIN INDUSTRIES, LTD., Osaka (JP)

(72) Inventors: Ryuuzaburou Yajima, Osaka (JP); Shingo Itou, Osaka (JP); Kouji Miwa, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/515,511

(22) Filed: Jul. 18, 2019

(65) Prior Publication Data

US 2019/0338981 A1 Nov. 7, 2019

Related U.S. Application Data

(62) Division of application No. 15/564,492, filed as application No. PCT/JP2016/061213 on Apr. 6, 2016, now abandoned.

(30) Foreign Application Priority Data

Apr. 6, 2015 (JP) ..... 2015-077487
Apr. 7, 2015 (JP) ..... 2015-078725

(51) Int. Cl.
*F24F 11/89* (2018.01)
*F24F 11/36* (2018.01)
(Continued)

(52) U.S. Cl.
CPC ..... *F24F 11/89* (2018.01); *F24F 7/08* (2013.01); *F24F 11/0001* (2013.01);
(Continued)

(58) Field of Classification Search
CPC .. F24F 11/89; F24F 11/65; F24F 11/36; F24F 11/30; F24F 1/00075; F24F 2003/005
See application file for complete search history.

(56) References Cited

U.S. PATENT DOCUMENTS 3,802,218 A * 4/1974 Yoshiro ..... F24F 1/01 62/324.1
4,024,728 A * 5/1977 Gustafsson ..... F24F 3/001 62/79

(Continued)

FOREIGN PATENT DOCUMENTS

JP 4-369370 A 12/1992
JP 08-178397 A 7/1996

(Continued)

OTHER PUBLICATIONS

Extended European Search Report dated Jul. 17, 2019 in corresponding European Application No. 19168660.9.

(Continued)

*Primary Examiner* — Nelson J Nieves
(74) *Attorney, Agent, or Firm* — Birch, Stewart, Kolasch & Birch, LLP

(57) ABSTRACT

A usage-side air-conditioning apparatus has: a casing; a usage-side heat exchanger to cool or heat air inside the casing through the use of a refrigerant supplied from a heat-source-side air-conditioning apparatus; an air supply/exhaust mechanism to take room air and/or outdoor air in from an air-conditioned space or outside of the air-conditioned space, supply the air as supply air to the air-conditioned space, and exhaust the air as exhaust air out of the air-conditioned space; and a refrigerant leakage detection device to detect the refrigerant. When the refrigerant leakage detection device has detected the refrigerant, a refrigerant exhaust operation is performed by the air supply/exhaust (Continued)

mechanism to exhaust the refrigerant out of the air-conditioned space along with the air inside the casing.

9 Claims, 14 Drawing Sheets

(51) Int. Cl.

| | |
|---|---|
| ***F24F 11/65*** | (2018.01) |
| ***F24F 11/30*** | (2018.01) |
| ***F24F 7/08*** | (2006.01) |
| ***F24F 11/00*** | (2018.01) |
| *F25B 13/00* | (2006.01) |
| *F24F 3/147* | (2006.01) |
| *F24F 110/50* | (2018.01) |

(52) U.S. Cl.
CPC ..... *F24F 11/30* (2018.01); *F24F 11/36* (2018.01); *F24F 11/65* (2018.01); *F24F 3/147* (2013.01); *F24F 2110/50* (2018.01); *F25B 13/00* (2013.01); *F25B 2313/0233* (2013.01); *F25B 2313/0293* (2013.01); *F25B 2400/12* (2013.01)

(56) References Cited

U.S. PATENT DOCUMENTS 4,124,998 A * 11/1978 Swiderski ..... F24F 3/00 62/442
4,367,631 A * 1/1983 Johnson ..... F24F 3/001 237/2 B
4,517,810 A * 5/1985 Foley ..... F24D 11/0214 62/186
4,928,750 A * 5/1990 Nurczyk ..... F24D 19/1084 165/216
5,344,069 A * 9/1994 Narikiyo ..... F24F 3/001 236/49.3
5,588,591 A * 12/1996 Sweitzer, Jr. ..... F24D 19/1033 237/8 C
6,378,317 B1 * 4/2002 Ribo ..... F24F 3/00 62/186
6,536,225 B1 * 3/2003 Yajima ..... F24F 1/02 62/407
7,228,709 B2 * 6/2007 Hwang ..... F24F 3/065 62/478
2005/0166624 A1 * 8/2005 Matsuoka ..... F16L 23/167 62/298
2006/0070719 A1 * 4/2006 Kim ..... F24F 1/26 165/61
2010/0240295 A1 * 9/2010 Akhtar ..... F24F 1/0007 454/262
2013/0192283 A1 * 8/2013 Yamashita ..... F24F 1/32 62/126
2014/0065939 A1 * 3/2014 Dietz ..... G05D 7/0658 454/229
2014/0123685 A1 * 5/2014 Kim ..... F25B 13/00 62/56
2015/0099450 A1 * 4/2015 Dupont ..... F02C 7/00 454/252
2015/0362204 A1 * 12/2015 Goel ..... F24F 11/83 62/180
2016/0091241 A1 * 3/2016 Suzuki ..... F25B 49/005 62/186
2016/0146488 A1 * 5/2016 Ochiai ..... F25B 13/00 62/125
2017/0051940 A1 * 2/2017 Horie ..... F24F 1/0007
2018/0073762 A1 3/2018 Yajima et al.
2018/0187917 A1 * 7/2018 Suzuki ..... F25B 49/02
2019/0195514 A1 * 6/2019 White ..... F24F 1/0007

FOREIGN PATENT DOCUMENTS

JP 8-327081 A 12/1996
JP 9-324928 A 12/1997
JP 2000-220877 A 8/2000
JP 3291407 B2 6/2002
JP 2004-286255 A 10/2004
JP 2005-241121 A 9/2005
JP 2009-168409 A 7/2009
JP 2011-75118 A 4/2011
JP 2014-082260 A 5/2014
JP 2016-196996 A 11/2016
WO WO 00/52394 A1 9/2000
WO WO 2013/038599 A1 3/2013
WO WO-2013038599 A1 * 3/2013 ..... F24F 1/0007

OTHER PUBLICATIONS

Dave Godwin et al. "Flammable Refrigerants", MAC Summit 2005; Mar. 16, 2005.
Extended European Search Report dated Nov. 7, 2018 in corresponding European Application No. 16776546.0.
International Preliminary Report on Patentability and English translation of the Written Opinion of the International Searching Authority (forms PCT/IB/373, PCT/ISA/237 and PCT/IB/338), dated Oct. 19, 2017, for International Application No. PCT/JP2016/061213.

* cited by examiner

USAGE-SIDE AIR-CONDITIONING APPARATUS AND AIR-CONDITIONING APPARATUS PROVIDED WITH SAME

This application is a Divisional of co-pending application Ser. No. 15/564,492, filed on Oct. 5, 2017, which is the National Phase under 35 U.S.C. § 371 of International Application No. PCT/JP2016/061213, filed on Apr. 6, 2016, which claims priority under 35 U.S.C. § 119(a) to Japanese Patent Application No. 2015-078725, filed on Apr. 7, 2015 and Japanese Patent Application No. 2015-077487, filed on Apr. 6, 2015, all of which are hereby expressly incorporated by reference into the present application.

TECHNICAL FIELD

The present invention relates to a usage-side air-conditioning apparatus, and particularly relates to: a usage-side air-conditioning apparatus having a usage-side heat exchanger to cool or heat air inside a casing by means of a refrigerant supplied from a heat-source-side air-conditioning apparatus, and an air supply/exhaust mechanism to take air into the casing from an air-conditioned space or outside an air-conditioned space and/or to supply the air inside the casing to the air-conditioned space or to the outside of the air-conditioned space; and an air-conditioning apparatus provided with such a usage-side air-conditioning apparatus.

BACKGROUND ART

In the past there have been ventilating air conditioners (usage-side air-conditioning apparatuses) that have an evaporator and/or condenser (usage-side heat exchangers) to cool or heat air inside a casing by means of a refrigerant supplied from an outdoor machine (a heat-source-side air-conditioning apparatus), and an air supply fan and/or air exhaust fan (air supply/exhaust mechanism) to take air into the casing from an air-conditioned space or outside an air-conditioned space and/or to supply the air inside the casing to the air-conditioned space or to the outside of the air-conditioned space, as is disclosed in Patent Literature 1 (Japanese Laid-open Patent Publication No. 2000-220877).

SUMMARY OF THE INVENTION

In such a usage-side air-conditioning apparatus having a ventilating air-condition function to ventilate and air-condition the interior of a room, when refrigerant leaks, there is a risk that the leaked refrigerant will be supplied to the air-conditioned space, and an oxygen deficiency accident, an ignition accident (when the refrigerant is slightly flammable or flammable), or a poisoning accident (when the refrigerant is toxic) will occur.

An object of the present invention is to ensure that when refrigerant leaks in a usage-side air-conditioning apparatus having a ventilating air-condition function and an air-conditioning apparatus provided with the same, the leaked refrigerant is quickly exhausted and not supplied to an air-conditioned space.

A usage-side air-conditioning apparatus according to a first aspect of the present invention comprises a casing, a usage-side heat exchanger, an air supply/exhaust mechanism, and a refrigerant leakage detection device. The usage-side heat exchanger, which is provided inside the casing, cools or heats air inside the casing through the use of a refrigerant supplied from a heat-source-side air-conditioning apparatus. The air supply/exhaust mechanism takes room air into the casing from an air-conditioned space, takes outdoor air into the casing from outside the air-conditioned space, supplies the air inside the casing as supply air to the air-conditioned space, and exhausts the air inside the casing as exhaust air out of the air-conditioned space. The refrigerant leakage detection device detects the refrigerant. In this aspect, when the refrigerant leakage detection device has detected the refrigerant, a refrigerant exhaust operation is performed by the air supply/exhaust mechanism to exhaust the refrigerant out of the air-conditioned space along with the air inside the casing.

In this aspect, when the refrigerant has leaked, the leaked refrigerant can be quickly exhausted and prevented from being supplied to the air-conditioned space, using the air supply/exhaust mechanism.

A usage-side air-conditioning apparatus according to a second aspect is the usage-side air-conditioning apparatus according to the first aspect, wherein a total heat exchanger to perform heat exchange between the outdoor air and the room air is provided inside the casing, and the air supply/exhaust mechanism has a first air supply blower provided so as to be able to take outdoor air in from outside the air-conditioned space and supply the supply air to the air-conditioned space, and a first air exhaust blower provided so as to be able to take room air in from the air-conditioned space and exhaust the exhaust air out of the air-conditioned space. In this aspect, the refrigerant exhaust operation is performed by operating the first air exhaust blower.

In this aspect, when the refrigerant has leaked, the leaked refrigerant can be quickly exhausted and prevented from being supplied to the air-conditioned space, by operating the first air exhaust blower configuring the air supply/exhaust mechanism.

A usage-side air-conditioning apparatus according to a third aspect is the usage-side air-conditioning apparatus according to the first aspect, wherein the air supply/exhaust mechanism has an air supply/exhaust blower provided to be capable of switching between an air supply state of taking the room air in from the air-conditioned space, taking the outdoor air in from outside the air-conditioned space, and supplying the supply air to the air-conditioned space, and an air exhaust state of exhausting the exhaust air out of the air-conditioned space. In this aspect, the refrigerant exhaust operation is performed by operating the air supply/exhaust blower in the air exhaust state.

In this aspect, when the refrigerant has leaked, the leaked refrigerant can be quickly exhausted and prevented from being supplied to the air-conditioned space, by operating the air supply/exhaust blower configuring the air supply/exhaust mechanism in the air exhaust state.

A usage-side air-conditioning apparatus according to a fourth aspect is the usage-side air-conditioning apparatus according to the first aspect, wherein the air supply/exhaust mechanism has a second air supply blower provided so as to be capable of taking the room air in from the air-conditioned space, taking the outdoor air in from outside the air-conditioned space, and supplying the supply air to the air-conditioned space, and a second air exhaust blower provided so as to be capable of exhausting the exhaust air out of the air-conditioned space. In this aspect, the refrigerant exhaust operation is performed by operating the second air exhaust blower.

In this aspect, when the refrigerant has leaked, the leaked refrigerant can be quickly exhausted and prevented from being supplied to the air-conditioned space, by operating the second air exhaust blower configuring the air supply/exhaust mechanism.

A usage-side air-conditioning apparatus according to a fifth aspect is the usage-side air-conditioning apparatus according to the first aspect, wherein the air supply/exhaust mechanism has a third air supply blower provided so as to be capable of taking the outdoor air in from outside the air-conditioned space and supplying the supply air to the air-conditioned space, and a third air exhaust blower provided so as to be capable of taking the room air in from the air-conditioned space, returning some of the room air to the outdoor air taken in by the third air supply blower, and exhausting the remnant of the room air as the exhaust air out of the air-conditioned space. In this aspect, the refrigerant exhaust operation is performed by operating the third air exhaust blower.

In this aspect, when the refrigerant has leaked, the leaked refrigerant can be quickly exhausted and prevented from being supplied to the air-conditioned space, by operating the third air exhaust blower configuring the air supply/exhaust mechanism.

A usage-side air-conditioning apparatus according to a sixth aspect is the usage-side air-conditioning apparatus according to any of the first through fifth aspects, wherein the usage-side heat exchanger is connected to the heat-source-side air-conditioning apparatus via a refrigerant interconnection pipe. In this aspect, a joint to connect the usage-side heat exchanger to the refrigerant interconnection pipe is provided inside the casing.

In this aspect, when the refrigerant has leaked from the joint to connect the usage-side heat exchanger to the refrigerant interconnection pipe, the refrigerant leaks into the casing. Therefore, when the refrigerant has leaked, the refrigerant can be quickly detected, and the leaked refrigerant can be quickly exhausted.

A usage-side air-conditioning apparatus according to a seventh aspect is the usage-side air-conditioning apparatus according to any of the first through fifth aspects, wherein the usage-side heat exchanger is connected to the heat-source-side air-conditioning apparatus via the refrigerant interconnection pipe, and a joint to connect the usage-side heat exchanger to the refrigerant interconnection pipe is provided outside the casing. In this aspect, the air supply/exhaust mechanism has an inside-outside communication mechanism capable of switching between an inside-outside communication state of allowing communication between the casing interior and a usage-side installation space in which the casing is provided, and an inside-outside non-communication state of not allowing communication between the casing interior and the usage-side installation space, and the refrigerant exhaust operation is performed by putting the inside-outside communication mechanism in the inside-outside communication state.

In this aspect, when the refrigerant has leaked from the joint to connect the usage-side heat exchanger to the refrigerant interconnection pipe, the refrigerant leaks into the usage-side installation space. However, in this aspect, the usage-side installation space and the casing interior can be allowed to communicate by the inside-outside communication mechanism. Therefore, in this aspect, when refrigerant has leaked, the refrigerant leaked into the usage-side installation space can be quickly exhausted while being guided into the casing, and prevented from being supplied to the air-conditioned space, using the air supply/exhaust mechanism including the inside-outside communication mechanism.

A usage-side air-conditioning apparatus according to an eighth aspect is the usage-side air-conditioning apparatus according to any of the first through seventh aspects, wherein the refrigerant is denser than air; and the refrigerant leakage detection device is provided to a lower part of the casing.

In this aspect, the refrigerant can be quickly detected using the tendency of the refrigerant denser than air to accumulate downward.

A usage-side air-conditioning apparatus according to a ninth aspect is the usage-side air-conditioning apparatus according to any of the first through seventh aspects, wherein the refrigerant is less dense than air; and the refrigerant leakage detection device is provided to an upper part of the casing.

In this aspect, the refrigerant can be quickly detected using the tendency of the refrigerant less dense than air to accumulate upward.

A usage-side air-conditioning apparatus according to a tenth aspect is the usage-side air-conditioning apparatus according to any of the first through ninth aspects, wherein the refrigerant is slightly flammable or flammable.

In this aspect, the occurrence of ignition accidents in the air-conditioned space can be suppressed.

A usage-side air-conditioning apparatus according to an eleventh aspect is the usage-side air-conditioning apparatus according to any of the first through ninth aspects, wherein the refrigerant is toxic.

In this aspect, the occurrence of poisoning accidents in the air-conditioned space can be suppressed.

A usage-side air-conditioning apparatus according to a twelfth aspect is the usage-side air-conditioning apparatus according to any of the first through ninth aspects, wherein the refrigerant is not slightly flammable, flammable, or toxic.

In this aspect, the occurrence of oxygen deficiency accidents in the air-conditioned space can be suppressed.

An air-conditioning apparatus according to a thirteenth aspect is configured by connecting a heat-source-side air-conditioning apparatus supplying refrigerant to a plurality of the usage-side air-conditioning apparatuses according to any of the first through twelfth aspects.

In this aspect, when the refrigerant has leaked in any of the plurality of usage-side air-conditioning apparatuses, the leaked refrigerant can be quickly exhausted using the air supply/exhaust mechanism of the usage-side air-conditioning apparatus in which the refrigerant has leaked, and the refrigerant can be prevented from being supplied to the air-conditioned space that is air-conditioned by the usage-side air-conditioning apparatus in which the refrigerant has leaked.

DESCRIPTION OF EMBODIMENTS

An embodiment of a usage-side air-conditioning apparatus according to the present invention and an air-conditioning apparatus provided with the same is described below with reference to the drawings. The specific configuration of an embodiment of the air-conditioning apparatus according to the present invention is not limited to the following embodiments or modifications thereof; the configuration can be changed within a range that does not deviate from the scope of the invention.

First Embodiment

(1) Configuration

Figure 1:
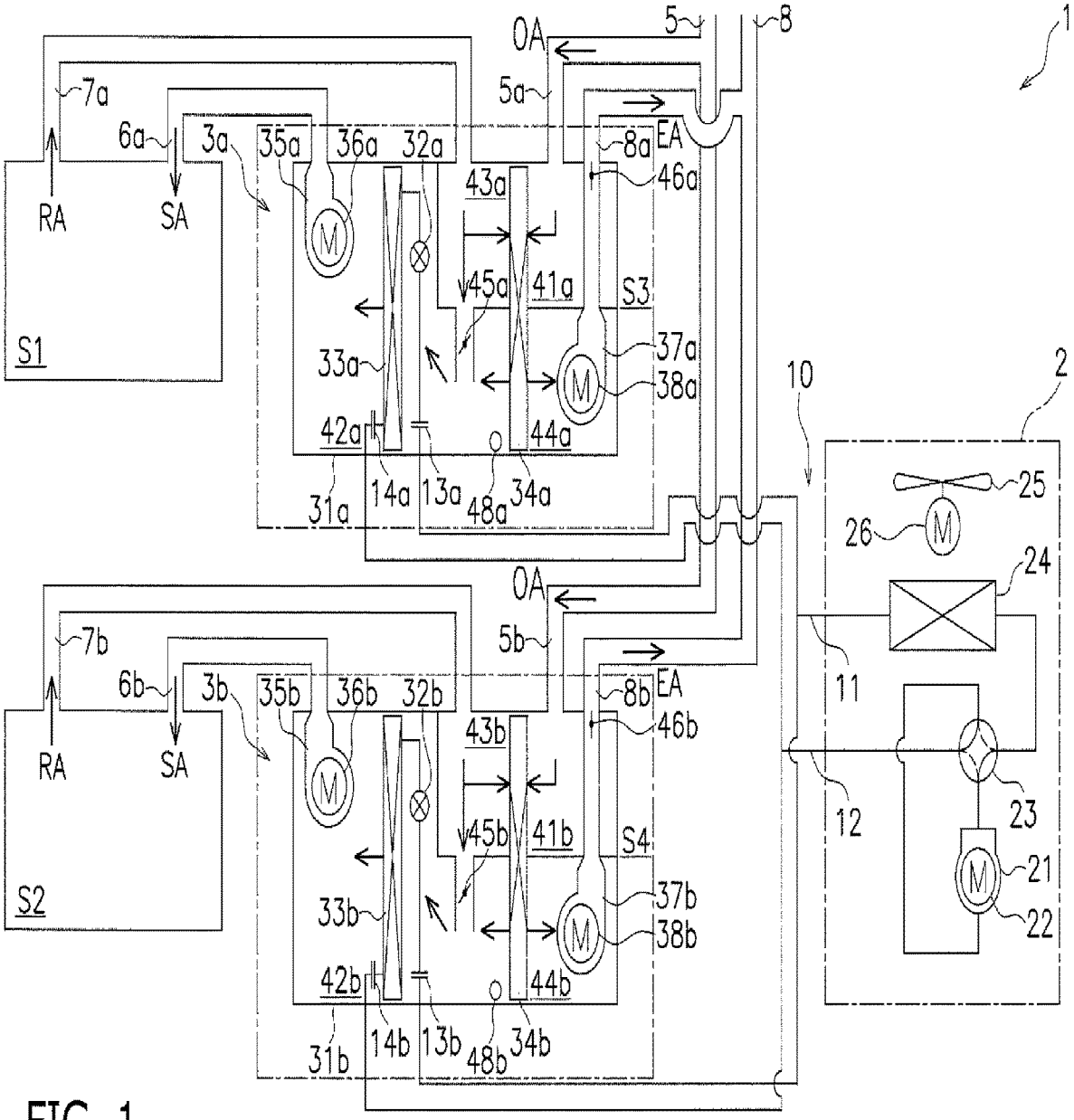
FIG. 1 is an overall configuration diagram of usage-side air-conditioning apparatuses according to a first embodiment of the present invention, and an air-conditioning apparatus provided with the same (the flow of air during normal operation and the like are also illustrated)
Figure 2:
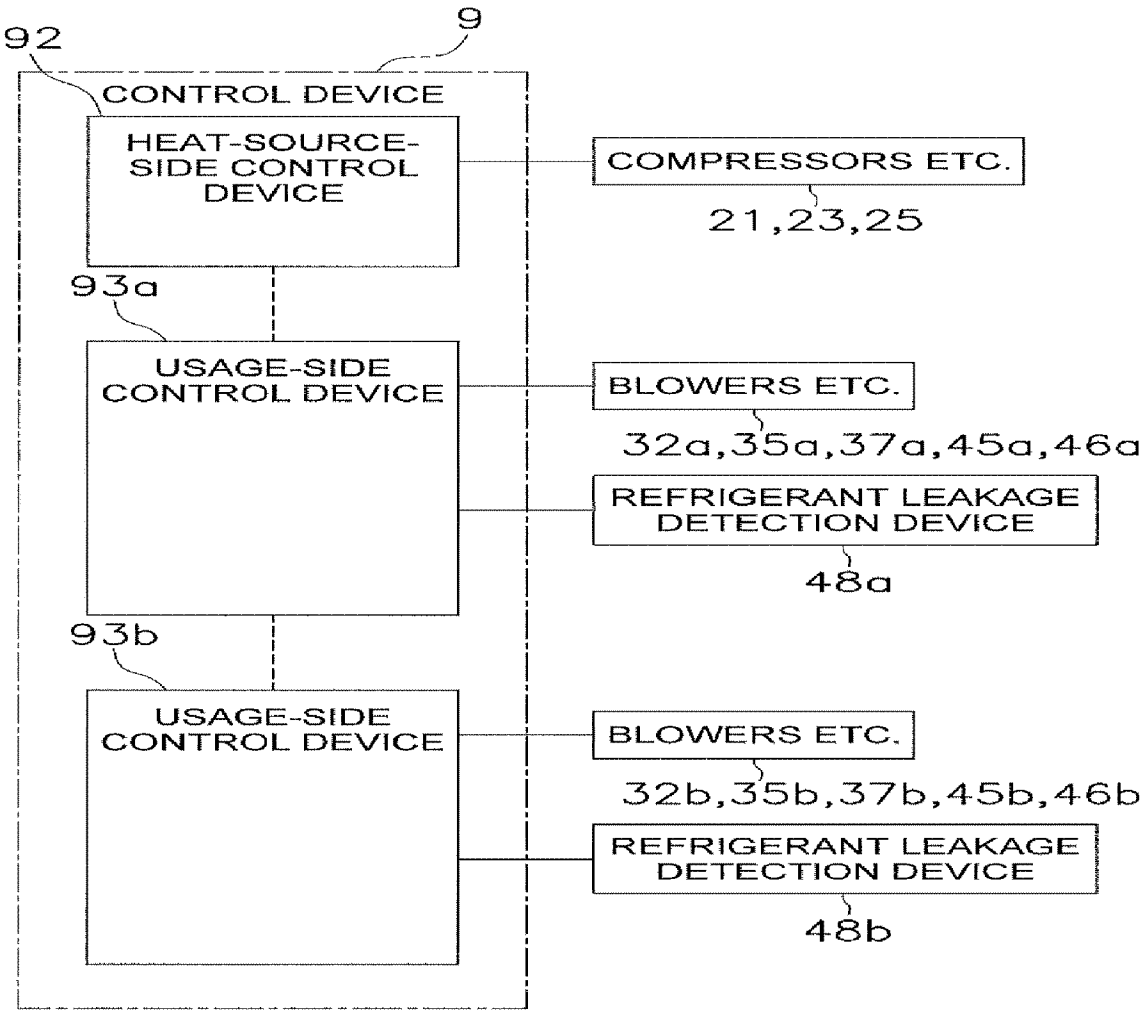
FIG. 2 is a control block diagram of the air-conditioning apparatus in the first embodiment.

FIG. 1 is an overall configuration diagram of usage-side air-conditioning apparatuses 3*a*, 3*b* according to a first embodiment of the present invention, and an air-conditioning apparatus 1 provided with the same. FIG. 2 is a control block diagram of the air-conditioning apparatus 1 in the first embodiment.

<Overall>

The air-conditioning apparatus 1, which is an air-conditioning ventilation system having a ventilating air-condition function for ventilating and air-conditioning the interior of a room, mainly has a heat-source-side air-conditioning apparatus 2, and a plurality (two in this embodiment) of usage-side air-conditioning apparatuses 3*a*, 3*b*.

The air-conditioning apparatus 1 has a refrigerant circuit 10 through which refrigerant circulates. The refrigerant circuit 10 is configured by connecting the heat-source-side air-conditioning apparatus 2 to the usage-side air-conditioning apparatuses 3*a*, 3*b*. In this embodiment, the heat-source-side air-conditioning apparatus 2 is installed in a location such as on the roof of a building, and the usage-side air-conditioning apparatuses 3*a*, 3*b* are installed in usage-side installation spaces (in this embodiment, usage-side installation spaces S3, S4), such as a machine room of the building or a space above the ceiling, in correspondence with air-conditioned spaces (in this embodiment, air-conditioned spaces S1, S2) that are ventilated and air-conditioned. The heat-source-side air-conditioning apparatus 2 and the usage-side air-conditioning apparatuses 3*a*, 3*b* are connected via refrigerant interconnection pipes 11, 12, thereby configuring the refrigerant circuit 10. The refrigerant sealed within the refrigerant circuit 10 is a slightly flammable refrigerant such as R32, a flammable refrigerant such as propane, or a toxic refrigerant such as ammonia.

The air-conditioning apparatus 1 has a plurality of air ducts. In this embodiment, the air-conditioning apparatus 1 has an intake duct 5 for taking outdoor air (OA) into the usage-side air-conditioning apparatuses 3*a*, 3*b* from outside the air-conditioned spaces S1, S2, air supply ducts 6*a*, 6*b* for supplying supply air (SA) from the usage-side air-conditioning apparatuses 3*a*, 3*b* to the air-conditioned spaces S1, S2, outtake ducts 7*a*, 7*b* for taking room air (RA) from the air-conditioned spaces S1, S2 into the corresponding usage-side air-conditioning apparatuses 3*a*, 3*b*, and an air exhaust duct 8 for exhausting exhaust air (EA) out of the air-conditioned spaces S1, S2 from the usage-side air-conditioning apparatuses 3*a*, 3*b*. Air can thereby be exchanged between the air-conditioned spaces S1, S2 and/or the outsides of the air-conditioned spaces S1, S2 and the usage-side air-conditioning apparatuses 3*a*, 3*b*. The intake duct 5 has intake branch ducts 5*a*, 5*b* that branch corresponding to the usage-side air-conditioning apparatuses 3*a*, 3*b*, and the air exhaust duct 8 has air exhaust branch ducts 8*a*, 8*b* that branch corresponding to the usage-side air-conditioning apparatuses 3*a*, 3*b*.

<Heat-Source-Side Air-Conditioning Apparatus>

The heat-source-side air-conditioning apparatus 2, as described above, is connected to the usage-side air-conditioning apparatuses 3*a*, 3*b* via the refrigerant interconnection pipes 11, 12, configuring part of the refrigerant circuit 10.

The heat-source-side air-conditioning apparatus 2 mainly has a compressor 21, a switching mechanism 23, and a heat-source-side heat exchanger 24.

The compressor 21 is a mechanism to compress the refrigerant, and in this embodiment, a sealed compressor is used in which a rotary, scroll, or other type of positive displacement compression element (not shown) accommodated in a casing (not shown) is driven by a compressor motor 22 also accommodated in the casing.

The switching mechanism 23 is a four-way switching valve capable of switching between an air-cooling operation state in which the heat-source-side heat exchanger 24 is caused to function as a heat radiator of the refrigerant, and an air-warming operation state in which the heat-source-side heat exchanger 24 is caused to function as an evaporator of the refrigerant. In this embodiment, the air-cooling operation state is a switched state in which a discharge side of the compressor 21 and a gas side of the heat-source-side heat exchanger 24 are allowed to communicate, and the gas refrigerant interconnection pipe 12 and an intake side of the compressor 21 are allowed to communicate (refer to the solid lines of the switching mechanism 23 in FIG. 1). The air-warming operation state is a switched state in which the discharge side of the compressor 21 and the gas refrigerant interconnection pipe 12 are allowed to communicate, and the gas side of the heat-source-side heat exchanger 24 and the intake side of the compressor 21 are allowed to communicate (refer to the dashed lines of the switching mechanism 23 in FIG. 1). The switching mechanism 23 is not limited to a four-way switching valve. For example, the switching mechanism 23 may be configured so as to have a function to switch the direction of refrigerant flow, similar to that described above, by a technique such as combining a plurality of electromagnetic valves.

The heat-source-side heat exchanger 24 functions as a heat radiator or an evaporator of the refrigerant by conducting heat exchange between the refrigerant and the outdoor air (OA). The outdoor air (OA), which exchanges heat with the refrigerant in the heat-source-side heat exchanger 24, is supplied to the heat-source-side heat exchanger 24 by a heat-source-side fan 25 driven by a heat-source-side fan motor 26.

<Usage-Side Air-Conditioning Apparatuses>

The usage-side air-conditioning apparatuses 3*a*, 3*b*, as described above, are connected to the heat-source-side air-conditioning apparatus 2 via the refrigerant interconnection pipes 11, 12, configuring part of the refrigerant circuit 10. Additionally, the usage-side air-conditioning apparatuses 3*a*, 3*b*, as described above, are designed so as to be able to exchange air with the air-conditioned spaces S1, S2 and/or the outsides of the air-conditioned spaces 51, S2 via the air ducts 5 (5*a*, 5*b*), 6*a*, 6*b*, 7*a*, 7*b*, 8 (8*a*, 8*b*). In the following description, the configuration of the usage-side air-conditioning apparatus 3*a* is described, and description of the configuration of the usage-side air-conditioning apparatus 3*b*, in which the additional letter "a" is replaced by "b" for each component, is omitted.

The usage-side air-conditioning apparatus 3*a* mainly has a casing 31*a*, a usage-side expansion mechanism 32*a*, a usage-side heat exchanger 33*a*, a total heat exchanger 34*a*, a first air supply blower 35*a*, a first air exhaust blower 37*a*, and a refrigerant leakage detection device 48*a*.

The casing 31*a* is installed in the usage-side installation space S3, and various ducts 5*a*, 6*a*, 7*a*, 8*a* are connected to the casing 31*a*. A space to accommodate the usage-side heat exchanger 33*a* and the like is formed in the casing 31*a*.

The usage-side expansion mechanism 32*a* is an electric expansion valve that can, by performing opening degree control, vary the flow rate of the refrigerant flowing through the usage-side heat exchanger 33*a*. The usage-side expansion mechanism 32*a* is provided inside the casing 31*a*. One end of the usage-side expansion mechanism 32*a* is connected to a liquid side of the usage-side heat exchanger 33*a*, and another end of the usage-side expansion mechanism 32*a* is connected to the liquid refrigerant interconnection pipe 11 via a joint 13*a*. The joint 13*a* is a pipe joint to connect the usage-side heat exchanger 33*a* to the refrigerant interconnection pipes 11, 12, and in this embodiment, is provided inside the casing 31*a*.

The usage-side heat exchanger 33*a* is a heat exchanger to cool or heat the air (RA and/or OA) in the casing 31*a* by means of the refrigerant supplied from the heat-source-side air-conditioning apparatus 2. The usage-side heat exchanger 33*a* is provided inside the casing 31*a*. The usage-side heat exchanger 33*a* is connected to the heat-source-side air-conditioning apparatus 2 via the refrigerant interconnection pipes 11, 12. A liquid side of the usage-side heat exchanger 33*a* is connected to the liquid refrigerant interconnection pipe 11 via the usage-side expansion mechanism 32*a* and the joint 13*a*, and a gas side of the usage-side heat exchanger 33*a* is connected to the gas refrigerant interconnection pipe 12 via a joint 14*a*. The joint 14*a* is a pipe joint to connect the usage-side heat exchanger 33*a* to the gas refrigerant interconnection pipe 12, and in this embodiment, is provided inside the casing 31*a*.

The total heat exchanger 34*a* conducts heat exchange between the outdoor air (OA) and the room air (RA). In this embodiment, a heat exchanger that causes sensible heat and latent heat to be exchanged simultaneously between the two types of air (OA and RA) is used as the total heat exchanger 34*a*. The total heat exchanger 34*a* is provided inside the casing 31*a*, and the space inside the casing 31*a* is divided by the total heat exchanger 34*a* into an air supply passage 42*a* and an outtake passage 43*a* on the side nearer to the air-conditioned space S1, and an intake passage 41*a* and an air exhaust passage 44*a* on the side farther from the air-conditioned space S1. The intake passage 41*a* communicates with the intake duct 5 (5*a*), the air supply passage 42*a* communicates with the air supply duct 6*a*, the outtake passage 43*a* communicates with the outtake duct 7*a*, and the air exhaust passage 44*a* communicates with the air exhaust duct 8 (8*a*). The usage-side expansion mechanism 32*a* and the usage-side heat exchanger 33*a* are provided inside the air supply passage 42*a* within the space inside the casing 31*a*, and in this embodiment, the joints 13*a*, 14*a* are also provided inside the air supply passage 42*a*. Therefore, the usage-side heat exchanger 33*a* is designed to cool or heat the air inside the air supply passage 42*a*. Additionally, the casing 31*a* is provided with an air return regulation mechanism 45*a* composed of a communication passage that allows communication between the air supply passage 42*a* and the outtake passage 43*a*, and an air damper placed in this communication passage. The air return regulation mechanism 45*a* is capable of switching between an air supply-outtake communication state of allowing the outtake passage 43*a* to communicate with the air supply passage 42*a* by opening the air damper, and an air supply-outtake non-communication state of not allowing the outtake passage 43*a* to communicate with the air supply passage 42*a* by closing the air damper.

The first air supply blower 35*a* is a fan provided so as to be able to take the outdoor air (OA) in from outside the air-conditioned space S1, and supply the supply air (SA) to the air-conditioned space S1. The first air supply blower 35*a* is provided inside the air supply passage 42*a*, and an outlet of this blower is connected to the air supply duct 6*a*. The first air supply blower 35*a* is designed to be driven by a first air supply blower motor 36*a*.

The first air exhaust blower 37*a* is a fan provided so as to be able to take the room air (RA) in from the air-conditioned space S1, and exhaust the exhaust air (EA) out of the air-conditioned space S1. The first air exhaust blower 37*a* is provided inside the air exhaust passage 44*a*, and an outlet of this blower is connected to the air exhaust duct 8 (8*a*). The first air exhaust blower 37*a* is designed to be driven by a first air exhaust blower motor 38*a*. Additionally, a backflow prevention mechanism 46*a* composed of an air damper is provided to the outlet of the first air exhaust blower 37*a*. The air damper of the backflow prevention mechanism 46*a* is designed to be opened in order to exhaust the exhaust air (EA) to the air exhaust duct 8 when the first air exhaust blower 37*a* is operating, and closed in order to prevent backflow of the exhaust air (EA) from the air exhaust duct 8 when the first air exhaust blower 37*a* has stopped operating. The backflow prevention mechanism 46*a* may be provided to the air exhaust branch duct 8*a* rather than the outlet of the first air exhaust blower 37*a*. The backflow prevention mechanism 46*a* may not be provided when there is guaranteed to be no backflow of the exhaust air (EA), such as cases in which a blower is provided to the air exhaust duct 8.

When the above-described air passages 41*a*, 42*a*, 43*a*, 44*a*, mechanisms 45*a*, 46*a*, and blowers 35*a*, 37*a* are connected with the air ducts 5 (5*a*), 6*a*, 6*b*, 7*a*, 7*b*, 8 (8*a*), an air supply/exhaust mechanism of the usage-side air-conditioning apparatus 3*a* is configured, which takes the room air (RA) into the casing 31*a* from the air-conditioned space S1, takes the outdoor air (OA) into the casing 31*a* from outside the air-conditioned space S1, supplies the air in the casing 31*a* as supply air (SA) to the air-conditioned space S1, and exhausts the air in the casing 31*a* as exhaust air (EA) out of the air-conditioned space S1.

The refrigerant leakage detection device 48*a* is a device to detect refrigerant. The refrigerant leakage detection device 48*a* is provided inside the casing 31*a*. In this embodiment, the refrigerant leakage detection device 48*a* is provided inside the air supply passage 42*a* in which the usage-side heat exchanger 33*a* (in this embodiment, the joints 13*a*, 14*a* and/or the usage-side expansion mechanism 32*a*) is placed. Furthermore, in this embodiment, the refrigerant leakage detection device 48*a* is provided either to a lower part (when the refrigerant is denser than air) of the casing 31*a* (in this embodiment, the air supply passage 42*a*) or an upper part (when the refrigerant is less dense than air) of the casing 31*a* (in this embodiment, the air supply passage 42*a*). FIG. 1 shows a case in which the refrigerant leakage detection device 48*a* is provided to the lower part of the casing 31*a*.

<Control Device>

The air-conditioning apparatus 1 has a control device 9 to perform operation control on the heat-source-side air-conditioning apparatus 2 and the usage-side air-conditioning apparatuses 3*a*, 3*b*, etc. The control device 9 mainly has a heat-source-side control device 92 to control the actions of the components (compressor, etc.) configuring the heat-source-side air-conditioning apparatus 2, and usage-side control devices 93*a*, 93*b* to control the actions of the components (fans, refrigerant leakage detection devices, etc.) configuring the usage-side air-conditioning apparatuses 3*a*, 3*b*. The heat-source-side control device 92, which is provided to the heat-source-side air-conditioning apparatus 2, has a microcomputer and/or a memory, etc. for performing control on the heat-source-side air-conditioning apparatus 2. The usage-side control devices 93*a*, 93*b*, which are provided to the usage-side air-conditioning apparatuses 3*a*, 3*b*, have microcomputers and/or memories, etc. for performing control on the usage-side air-conditioning apparatuses 3*a*, 3*b*. The heat-source-side control device 92 and the usage-side control devices 93*a*, 93*b* are connected so as to be capable of exchanging, for example, control signals via a transmission line, and the control device 9 of the air-conditioning apparatus 1 is thereby configured. In this embodiment, the control devices 92, 93*a*, 93*b* are connected via a transmission line, but are not limited to being connected in this manner and may be connected wirelessly or by another connection method.

(2) Operations

In the air-conditioning apparatus 1 having the configuration described above, the following operations are performed. Operation controls of the air-conditioning apparatus 1 described below are performed by the control device 9.

<Normal Operation>

In normal operation, an operation is performed such that the outdoor air (OA) is taken into the casings 31*a*, 31*b* from outside the air-conditioned spaces S1, S2, the air is cooled or heated in the usage-side heat exchangers 33*a*, 33*b* and then supplied as supply air (SA) to the air-conditioned spaces S1, S2, the room air (RA) is taken into the casings 31*a*, 31*b* from the air-conditioned spaces S1, S2, the air exchanges heat with the outdoor air (OA) in the total heat exchangers 34*a*, 34*b*, and then which the air is exhausted as exhaust air (EA) out of the air-conditioned spaces S1, S2, as shown in FIG. 1. Specifically, operation control such as the following is performed on the components of the air-conditioning apparatus 1.

When air is supplied as supply air (SA) to the air-conditioned spaces S1, S2 after being cooled in the usage-side heat exchangers 33*a*, 33*b*, in the heat-source-side air-conditioning apparatus 2, the switching mechanism 23 is switched to the air-cooling operation state (the state shown by the solid lines of the switching mechanism 23 in FIG. 1), and the compressor 21 and the heat-source-side fan 25 are driven. High-pressure gas refrigerant discharged from the compressor 21 is thereby sent through the switching mechanism 23 to the heat-source-side heat exchanger 24 functioning as a heat radiator of the refrigerant. The high-pressure gas refrigerant sent to the heat-source-side heat exchanger 24 is condensed to high-pressure liquid refrigerant due to being cooled by heat exchange with the outdoor air (OA) supplied by the heat-source-side fan 25 in the heat-source-side heat exchanger 24. This high-pressure liquid refrigerant is sent to the usage-side air-conditioning apparatuses 3*a*, 3*b* via the liquid refrigerant interconnection pipe 11. The high-pressure liquid refrigerant sent to the usage-side air-conditioning apparatuses 3*a*, 3*b* is decompressed to low-pressure, gas-liquid two-phase refrigerant by the usage-side expansion mechanisms 32*a*, 32*b*. This low-pressure, gas-liquid two-phase refrigerant is sent to the usage-side heat exchangers 33*a*, 33*b* functioning as evaporators of the refrigerant. The low-pressure, gas-liquid two-phase refrigerant sent to the usage-side heat exchangers 33*a*, 33*b* is evaporated in the usage-side heat exchangers 33*a*, 33*b* to low-pressure gas refrigerant due to being heated by heat exchange with the air inside the air supply passages 42*a*, 42*b*. This low-pressure gas refrigerant is sent to the heat-source-side air-conditioning apparatus 2 via the gas refrigerant interconnection pipe 12. The low-pressure gas refrigerant sent to the heat-source-side air-conditioning apparatus 2 is drawn into the compressor 21 via the switching mechanism 23.

When air is supplied as supply air (SA) to the air-conditioned spaces S1, S2 after being heated in the usage-side heat exchangers 33*a*, 33*b*, in the heat-source-side air-conditioning apparatus 2, the switching mechanism 23 is switched to the air-warming operation state (the state shown by the dashed lines of the switching mechanism 23 in FIG. 1), and the compressor 21 and the heat-source-side fan 25 are driven. High-pressure gas refrigerant discharged from the compressor 21 is thereby sent to the usage-side air-conditioning apparatuses 3*a*, 3*b* via the switching mechanism 23 and the gas refrigerant interconnection pipe 12. The high-pressure gas refrigerant sent to the usage-side air-conditioning apparatuses 3*a*, 3*b* is sent to the usage-side heat exchangers 33*a*, 33*b* functioning as heat radiators of the refrigerant. The high-pressure gas refrigerant sent to the usage-side heat exchangers 33*a*, 33*b* is condensed in the usage-side heat exchangers 33*a*, 33*b* to high-pressure liquid refrigerant due to being cooled by heat exchange with the air inside the air supply passages 42*a*, 42*b*. This high-pressure liquid refrigerant decompressed by the usage-side expansion mechanisms 32*a*, 32*b*. The refrigerant decompressed by the usage-side expansion mechanisms 32*a*, 32*b* is sent to the heat-source-side air-conditioning apparatus 2 via the liquid refrigerant interconnection pipe 11. The refrigerant sent to the heat-source-side air-conditioning apparatus 2 is sent to the heat-source-side heat exchanger 24 functioning as an evaporator of the refrigerant. The refrigerant sent to the heat-source-side heat exchanger 24 is evaporated in the heat-source-side heat exchanger 24 to low-pressure gas refrigerant due to being heated by heat exchange with the outdoor air (OA) supplied by the heat-source-side fan 25. This low-pressure gas refrigerant is drawn into the compressor 21 via the switching mechanism 23.

At this time, in the usage-side air-conditioning apparatuses 3*a*, 3*b*, the backflow prevention mechanisms 46*a*, 46*b* are opened, and the first air supply blowers 35*a*, 35*b* and the first air exhaust blowers 37*a*, 37*b* are driven. This causes outdoor air (OA) to be taken through the intake duct 5 (5*a*, 5*b*) into the intake passages 41*a*, 41*b* of the casings 31*a*, 31*b* from outside the air-conditioned spaces S1, S2, and room air (RA) to be taken through the outtake ducts 7*a*, 7*b* into the outtake passages 43*a*, 43*b* of the casings 31*a*, 31*b* from the air-conditioned spaces 51, S2. The outdoor air (OA) and the room air (RA) taken into the casings 31*a*, 31*b* are caused to exchange heat in the total heat exchangers 34*a*, 34*b*, and are respectively sent to the air supply passage 42*a* and the air exhaust passage 44*a*. In this embodiment, when the air return regulation mechanisms 45*a*, 45*b* are switched to the air supply-outtake communication state (refer to the air return regulation mechanisms 45*a*, 45*b* in FIG. 1), some of the room air (RA) taken into the casings 31*a*, 31*b* is sent to the air supply passage 42*a* in accordance with the opening degrees of the air dampers of the air return regulation mechanisms 45*a*, 45*b*, and this air merges with the outdoor air (OA) which has undergone heat exchange in the total heat exchangers 34*a*, 34*b*. When the air return regulation mechanisms 45*a*, 45*b* are switched to the air supply-outtake non-communication state, all of the room air (RA) taken into the casings 31*a*, 31*b* undergoes heat exchange with all of the outdoor air (OA) taken into the casings 31*a*, 31*b*. The room air (RA) sent to the air exhaust passages 44*a*, 44*b* is then exhausted as exhaust air (EA) out of the air-conditioned spaces S1, S2 through the first air exhaust blowers 37*a*, 37*b* and the air exhaust duct 8 (8*a*, 8*b*). The outdoor air (OA) or the outdoor air (OA) including room air (RA) sent to the air supply passages 42*a*, 42*b* is cooled or heated in the usage-side heat exchangers 33*a*, 33*b* by the refrigerant supplied from the heat-source-side air-conditioning apparatus 2 through the liquid refrigerant interconnection pipe 11. The outdoor air (OA) or the outdoor air (OA) including room air (RA) cooled or heated in the usage-side heat exchangers 33*a*, 33*b* is supplied as supply air (SA) to the air-conditioned spaces S1, S2 through the first air supply blowers 35*a*, 35*b* and the air supply ducts 6*a*, 6*b*.

<Refrigerant Exhaust Operation>

During the normal operation described above, when refrigerant leaks in the usage-side air-conditioning apparatuses 3*a*, 3*b*, the leaked refrigerant is supplied to the air-conditioned spaces S1, S2, and there is a risk of ignition accidents (when the refrigerant is slightly flammable or flammable) or poisoning accidents (when the refrigerant is toxic) occurring. In view of this, when the refrigerant leakage detection devices 48*a*, 48*b* detect refrigerant, a refrigerant exhaust operation is performed to exhaust refrigerant together with the air in the casings 31*a*, 31*b* out of the air-conditioned spaces S1, S2, by means of the air supply/exhaust mechanisms. In this embodiment, the refrigerant exhaust operation is performed by operating the first air exhaust blowers 37*a*, 37*b* configuring the air supply/exhaust mechanisms.

Figure 3:
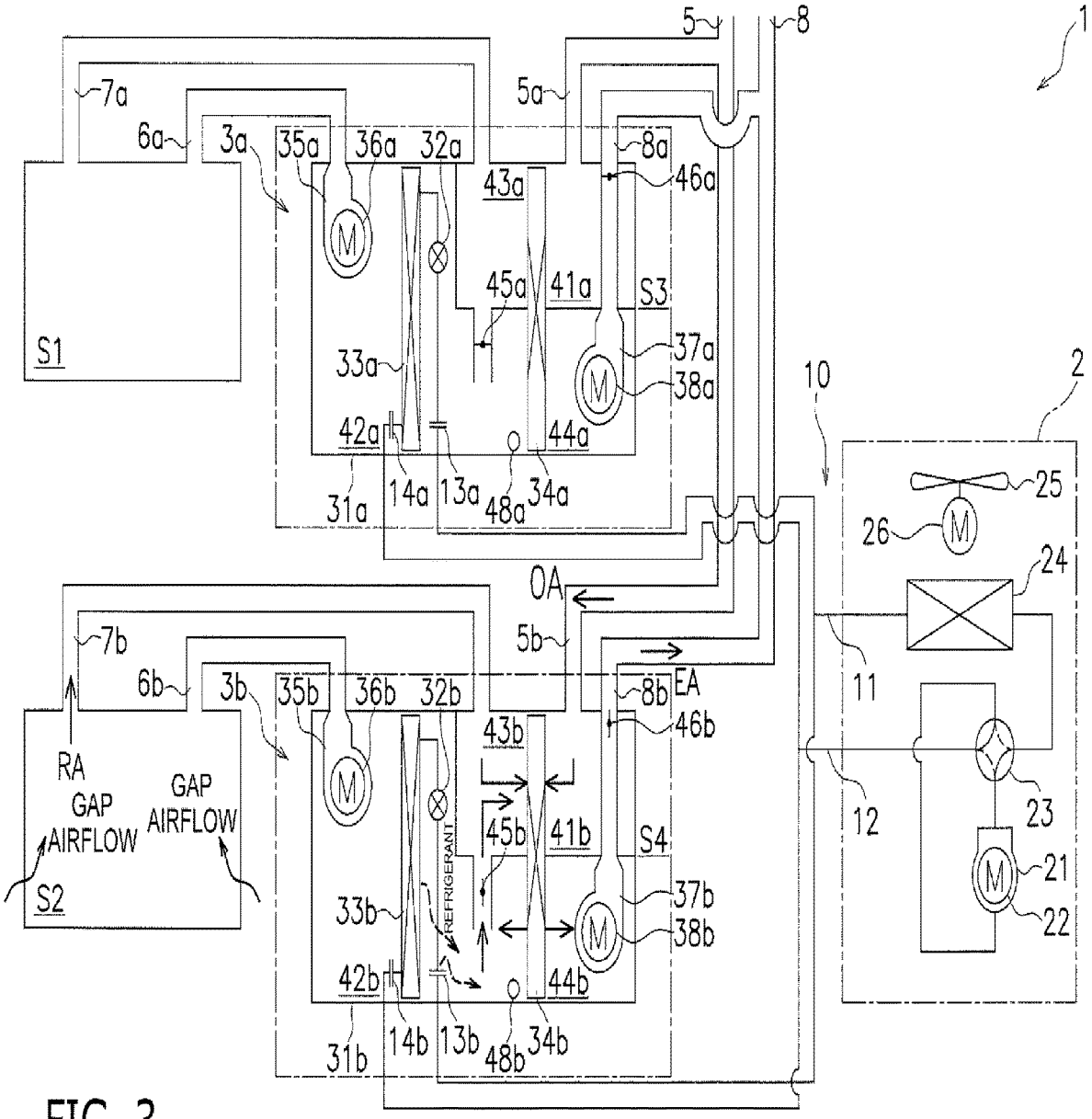
FIG. 3 is a diagram showing air flow during a refrigerant exhaust operation and the like in the first embodiment.

For example, supposing a case in which refrigerant has leaked in the usage-side air-conditioning apparatus 3*b* (i.e., the refrigerant leakage detection device 48*b* has detected refrigerant), the first air exhaust blower 37*b* is operated in the usage-side air-conditioning apparatus 3*b* as shown in FIG. 3. The leaked refrigerant, along with the air in the casing 31*b*, is thereby passed through the section of the total heat exchanger 34*b* communicating with the outtake passage 43*b* and the air exhaust passage 44*b*, and exhausted to the air exhaust duct 8 (8*b*). At this time, because the usage-side heat exchanger 33*b* and the joints 13*b*, 14*b*, which have a high possibility of refrigerant leakage, are placed in the air supply passage 42*b*, the air supply passage 42*b* and the outtake passage 43*b* are allowed to communicate and refrigerant exhaust is facilitated by putting the air return regulation mechanism 45*b* in the air supply-outtake communication state. The first air supply blower 35*b* is stopped to prevent the leaked refrigerant from being supplied to the air-conditioned space S2. In this embodiment, when the first air supply blower 35*b* is stopped and the first air exhaust blower 37*b* is operated, room air (RA) is taken into the casing 31*b* from the air-conditioned space S2, outdoor air (OA) is taken into the casing 31*b* from outside the air-conditioned space S2, and these two types of air (RA and OA) are therefore exhausted to the air exhaust duct 8 (8*b*) along with the leaked refrigerant. In the heat-source-side air-conditioning apparatus 2, refrigerant is prevented from being supplied from the heat-source-side air-conditioning apparatus 2 to the usage-side air-conditioning apparatus 3*b*, for example, due to the compressor 21 being stopped. In the usage-side air-conditioning apparatus 3*a*, in which refrigerant is not leaking, the refrigerant that leaked in the usage-side air-conditioning apparatus 3*b* is prevented from flowing back to the casing 31*a* through the air exhaust duct 8 (8*a*) by closing the backflow prevention mechanism 46*a*.

(3) Characteristics

The usage-side air-conditioning apparatuses 3*a*, 3*b* of the present embodiment and the air-conditioning apparatus 1 provided with the same have characteristics such as the following.

<A>

In this embodiment, as described above, in the usage-side air-conditioning apparatuses 3*a*, 3*b* having the ventilating air-condition function and the air-conditioning apparatus 1 provided with the same, when the refrigerant leakage detection devices 48*a*, 48*b* detect refrigerant, the refrigerant exhaust operation is performed by the air supply/exhaust mechanisms to exhaust the refrigerant along with the air in the casings 31*a*, 31*b* out of the air-conditioned spaces S1, S2. Particularly, in this embodiment, the refrigerant exhaust operation is performed by operating the first air exhaust blowers 37*a*, 37*b*. Additionally, in this embodiment, the air-conditioning apparatus 1 is configured by connecting the heat-source-side air-conditioning apparatus 2 and the plurality (two in this embodiment) of usage-side air-conditioning apparatuses 3*a*, 3*b*.

In this embodiment, when refrigerant leaks, it is thereby possible to ensure that the leaked refrigerant is quickly exhausted and not supplied to the air-conditioned spaces S1, S2, using the air supply/exhaust mechanisms (in this embodiment, by operating the first air exhaust blowers 37*a*, 37*b*). Additionally, in this embodiment, when refrigerant has leaked in any of the plurality of usage-side air-conditioning apparatuses 3*a*, 3*b*, it is possible to ensure that the leaked refrigerant is quickly exhausted using the air supply/exhaust mechanism of the usage-side air-conditioning apparatus 3*a* or 3*b* in which the refrigerant has leaked, and that the refrigerant is not supplied to the air-conditioned space S1 or S2 that is being air-conditioned by the usage-side air-conditioning apparatus 3*a* or 3*b* in which the refrigerant has leaked.

When the refrigerant is slightly flammable or flammable, the occurrence of ignition accidents in the air-conditioned spaces S1, S2 can be suppressed. When the refrigerant is toxic, the occurrence of poisoning accidents in the air-conditioned spaces S1, S2 can be suppressed. The occurrence of oxygen deficiency accidents in the air-conditioned spaces S1, S2 can be suppressed even when the refrigerant is not slightly flammable, flammable, or toxic.

<B>

In this embodiment, as described above, the joints 13*a*, 13*b*, 14*a*, 14*b* connecting the usage-side heat exchangers 33*a*, 33*b* to the refrigerant interconnection pipes 11, 12 are provided inside the casings 31*a*, 31*b*. Therefore, when refrigerant leaks from the joints 13*a*, 13*b*, 14*a*, 14*b* connecting the usage-side heat exchangers 33*a*, 33*b* to the refrigerant interconnection pipes 11, 12, the leakage is inside the casings 31*a*, 31*b*.

It is thereby possible in this embodiment to quickly detect the refrigerant when the refrigerant has leaked, and to quickly exhaust the leaked refrigerant.

<C>

In this embodiment, as described above, when the refrigerant is denser than air, the refrigerant leakage detection devices 48*a*, 48*b* are provided in the lower parts of the casings 31*a*, 31*b*.

It is thereby possible in this embodiment to quickly detect the refrigerant utilizing the tendency of the refrigerant denser than air to accumulate downward.

In this embodiment, as described above, when the refrigerant is less dense than air, the refrigerant leakage detection devices 48*a*, 48*b* are provided in the upper parts of the casings 31*a*, 31*b*.

It is thereby possible in this embodiment to quickly detect the refrigerant utilizing the tendency of the refrigerant less dense than air to accumulate upward.

(4) Modifications

Figure 4:
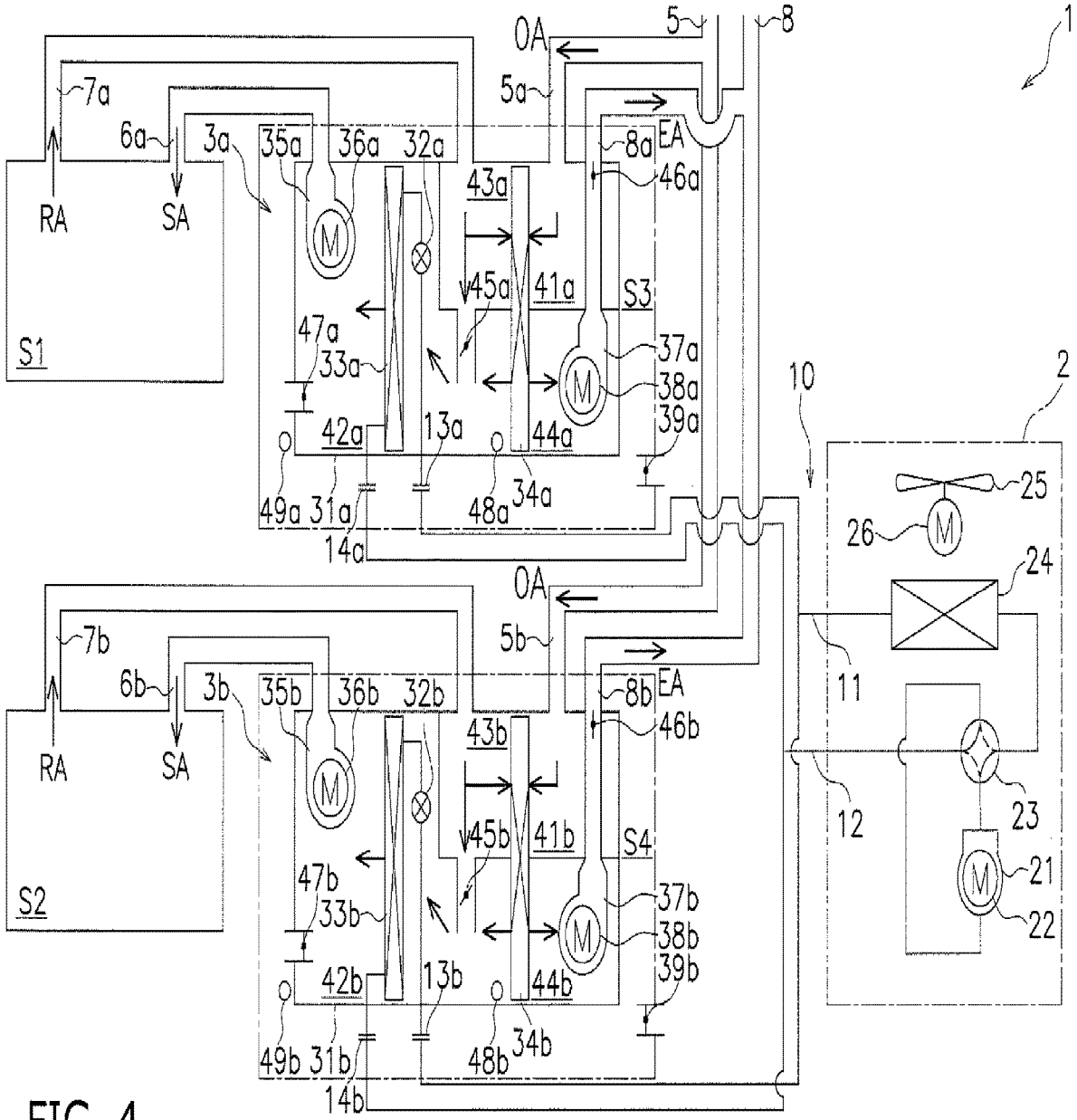
FIG. 4 is an overall configuration diagram of the usage-side air-conditioning apparatuses according to a modification of the first embodiment and an air-conditioning apparatus provided with the same (the flow of air during normal operation and the like are also illustrated)

In the above-described usage-side air-conditioning apparatuses 3*a*, 3*b* and the air-conditioning apparatus 1 provided with the same (see FIGS. 1 to 3), the joints 13*a*, 13*b*, 14*a*, 14*b* connecting the usage-side heat exchangers 33*a*, 33*b* to the refrigerant interconnection pipes are provided inside the casings 31*a*, 31*b*, but there are also cases in which the joints 13*a*, 13*b*, 14*a*, 14*b* are provided outside of the casings 31*a*, 31*b*, as shown in FIG. 4. In these cases, when refrigerant leaks from the joints 13*a*, 13*b*, 14*a*, 14*b*, the leakage occurs in the usage-side installation spaces S3, S4 in which the casings 31*a*, 31*b* of the usage-side air-conditioning apparatuses 3*a*, 3*b* are installed.

Figure 5:
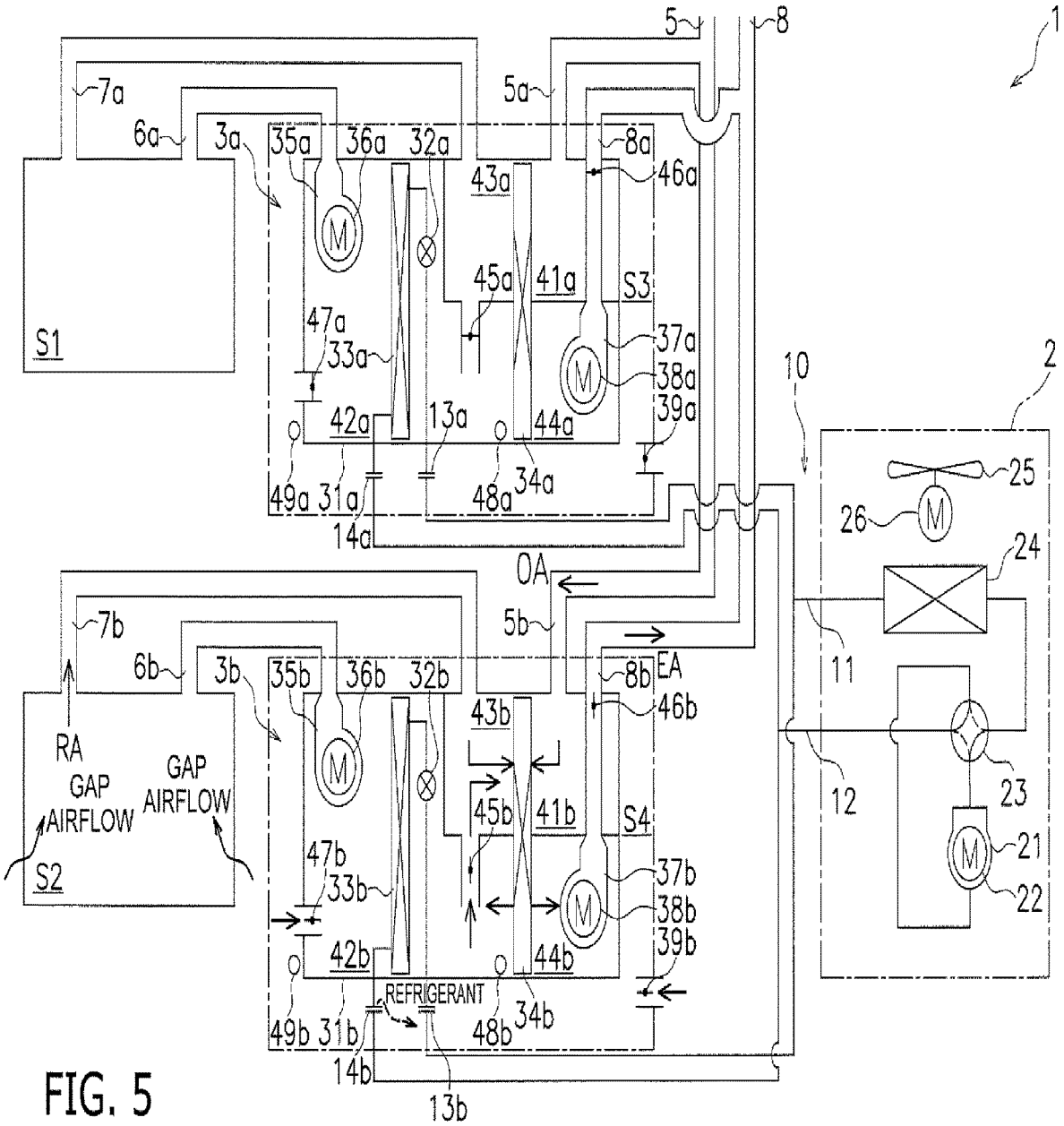
FIG. 5 is a diagram showing air flow during a refrigerant exhaust operation and the like in a modification of the first embodiment.

In view of this, in this modification, the usage-side air-conditioning apparatuses 3*a*, 3*b* are provided with inside-outside communication mechanisms 47*a*, 47*b*, which are capable of switching between an inside-outside communication state of allowing the usage-side installation spaces S3, S4 and the interiors of the casings 31*a*, 31*b* to communicate, and an inside-outside non-communication state of not allowing the usage-side installation spaces S3, S4 and the interiors of the casings 31*a*, 31*b* to communicate, as shown in FIGS. 4 and 5, and the refrigerant exhaust operation is performed by putting the inside-outside communication mechanisms 47*a*, 47*b* in the inside-outside communication state.

The following is a description, using FIGS. 2, 4, and 5, of the configurations and operations of the usage-side air-conditioning apparatuses 3*a*, 3*b* according to the present modification and the air-conditioning apparatus 1 provided with the same, focusing on the differences with the above-described usage-side air-conditioning apparatuses 3*a*, 3*b* and the air-conditioning apparatus 1 provided with the same (see FIGS. 1 to 3).

Firstly, the configurations of the usage-side air-conditioning apparatuses 3*a*, 3*b* according to the present modification and the air-conditioning apparatus 1 provided with the same are described. In this modification, the overall configuration of the air-conditioning apparatus 1 according to the present modification, and the configuration of the heat-source-side air-conditioning apparatus 2 according to the present modification, are similar to the above-described configuration of the air-conditioning apparatus 1 (see FIG. 1) and the configuration of the heat-source-side air-conditioning apparatus 2 (see FIG. 1), and are therefore not described here.

The configurations of the usage-side air-conditioning apparatuses 3*a*, 3*b* according to the present modification differ from the configurations of the usage-side air-conditioning apparatuses 3*a*, 3*b* described above (see FIG. 1) in that the joints 13*a*, 13*b*, 14*a*, 14*b* connecting the usage-side heat exchangers 33*a*, 33*b* to the refrigerant interconnection pipes are provided outside of the casings 31*a*, 31*b*, as shown in FIG. 4. The casings 31*a*, 31*b* are also provided with the inside-outside communication mechanisms 47*a*, 47*b* as described above. The inside-outside communication mechanisms 47*a*, 47*b* are composed of communication passages to allow communication between the air supply passages 42*a*, 42*b* and the usage-side installation spaces S3, S4, and air dampers placed in these communication passages. The inside-outside communication mechanisms 47*a*, 47*b* are capable of switching between an inside-outside communication state of allowing the air supply passages 42*a*, 42*b* and the usage-side installation spaces S3, S4 to communicate by opening the air dampers, and an inside-outside non-communication state of not allowing the air supply passages 42*a*, 42*b* and the usage-side installation spaces S3, S4 to communicate. Also provided to the outsides of the casings 31*a*, 31*b* are refrigerant leakage detection devices 49*a*, 49*b* to detect refrigerant that has leaked in the usage-side installation spaces S3, S4. Also provided to the usage-side installation spaces S3, S4 are installation space inside-outside communication mechanisms 39*a*, 39*b* composed of communication passages communicating with the outsides of the usage-side installation spaces S3, S4 and air dampers placed in these communication passages. The installation space inside-outside communication mechanisms 39*a*, 39*b* are capable of switching between an installation space inside-outside communication state of allowing the usage-side installation spaces S3, S4 and the exteriors thereof to communicate by opening the air dampers, and an installation space inside-outside non-communication state of not allowing the usage-side installation spaces S3, S4 and the exteriors thereof to communicate by closing the air dampers. The inside-outside communication mechanisms 47*a*, 47*b* and the installation space inside-outside communication mechanisms 39*a*, 39*b*, together with the air passages 41*a*, 42*a*, 43*a*, 44*a*, the mechanisms 45*a*, 46*a*, and the air blowers 35*a*, 37*a*, configure the air supply/exhaust mechanisms of the usage-side air-conditioning apparatuses 3*a*, 3*b* according to the present modification. The configurations of the usage-side air-conditioning apparatuses 3*a*, 3*b* according to the present modification are otherwise similar to the configurations of the usage-side air-conditioning apparatuses 3*a*, 3*b* described above (see FIG. 1), and are therefore not described here.

The configuration of a control device 9 according to the present modification is similar to the configuration of the control device 9 described above (see FIG. 2), aside from the feature that operation control is performed on the newly provided inside-outside communication mechanisms 47*a*, 47*b*, refrigerant leakage detection devices 49*a*, 49*b*, and installation space inside-outside communication mechanisms 39*a*, 39*b*; and is therefore not illustrated or described here.

Next, the operations of the usage-side air-conditioning apparatuses 3*a*, 3*b* according to the present modification and the air-conditioning apparatus 1 provided with the same are described. In this modification, the operation of the heat-source-side air-conditioning apparatus 2 of the air-conditioning apparatus 1 according to the present modification is similar to the operation of the heat-source-side air-conditioning apparatus 2 of the air-conditioning apparatus 1 described above, and is therefore not described here.

During normal operation, the operation of the usage-side air-conditioning apparatuses 3*a*, 3*b* according to the present modification involves putting the inside-outside communication mechanisms 47*a*, 47*b* into the inside-outside non-communication state and the installation space inside-outside communication mechanisms 39*a*, 39*b* into the installation space inside-outside non-communication state as shown in FIG. 4, and the resulting operation is substantially similar to the normal operation of the usage-side air-conditioning apparatuses 3*a*, 3*b* described above (see FIG. 1).

However, the refrigerant exhaust operation of the usage-side air-conditioning apparatuses 3*a*, 3*b* according to the present modification differs from the refrigerant exhaust operation of the usage-side air-conditioning apparatuses 3*a*, 3*b* described above (see FIG. 3) in that the inside-outside communication mechanisms 47*a*, 47*b* are put into the inside-outside communication state, as described above.

For example, supposing that refrigerant has leaked in the usage-side air-conditioning apparatus 3*b* (specifically, that the refrigerant leakage detection devices 48*b*, 49*b* have detected refrigerant), in the usage-side air-conditioning apparatus 3*b*, the inside-outside communication mechanism 47*b* is put into the inside-outside communication state and the first air exhaust blower 37*b* is operated, as shown in FIG. 5. The leaked refrigerant, along with the air in the casing 31*b* is thereby passed through the section of the total heat exchanger 34*b* communicating with the outtake passage 43*b* and the air exhaust passage 44*b*, and exhausted to the air exhaust duct 8 (8*b*). At this time, because the joints 13*b*, 14*b*, which have a high possibility of refrigerant leakage, are placed outside the casing 31*b* (the usage-side installation space S4), refrigerant sometimes leaks into the usage-side installation space S4, but because the air supply passage 42*b* of the casing 31*b* and the usage-side installation space S4 are allowed to communicate by putting the inside-outside communication mechanism 47*b* into the inside-outside communication state as described above, the refrigerant leaked into the usage-side installation space S4 is guided into the casing 31*b* using the inside-outside communication mechanism 47*b*, and along with the air in the casing 31*b*, the refrigerant is passed through the section of the total heat exchanger 34*b* communicating with the outtake passage 43*b* and the air exhaust passage 44*b* and exhausted to the air exhaust duct 8 (8*b*). Additionally, the installation space inside-outside communication mechanisms 39*a*, 39*b* are put into the installation space inside-outside communication state, making it easier for air to be guided from the usage-side installation space S4 into the air supply passage 42*b*. Other operative actions in the refrigerant exhaust operation according to the present modification are similar to those of the refrigerant exhaust operation in the usage-side air-conditioning apparatuses 3*a*, 3*b* described above (see FIG. 3), and are therefore not described here.

In such usage-side air-conditioning apparatuses 3*a*, 3*b* according to the present modification and the air-conditioning apparatus 1 provided with the same, because the joints 13*a*, 13*b*, 14*a*, 14*b* are provided outside the casings 31*a*, 31*b*, the operational effects derived from providing the joints 13*a*, 13*b*, 14*a*, 14*b* inside the casings 31*a*, 31*b* cannot be achieved, but in other aspects, the same operational effects can be achieved as those of the usage-side air-conditioning apparatuses 3*a*, 3*b* described above and the air-conditioning apparatus 1 provided with the same (see FIGS. 1 to 3).

Additionally, in this modification, communication between the usage-side installation spaces S3, S4 and the casing interiors can be allowed by the inside-outside communication mechanisms 47*a*, 47*b*, regardless of the joints 13*a*, 13*b*, 14*a*, 14*b* being provided outside the casings 31*a*, 31*b*. Therefore, in this modification, when refrigerant has leaked, the refrigerant leaked into the usage-side installation spaces S3, S4 can be quickly exhausted while being guided into the casings 31*a*, 31*b* and can be prevented from being supplied to the air-conditioned spaces 51, S2, using the air supply/exhaust mechanisms including the inside-outside communication mechanisms 47*a*, 47*b*.

Second Embodiment

(1) Configuration

Figure 6:
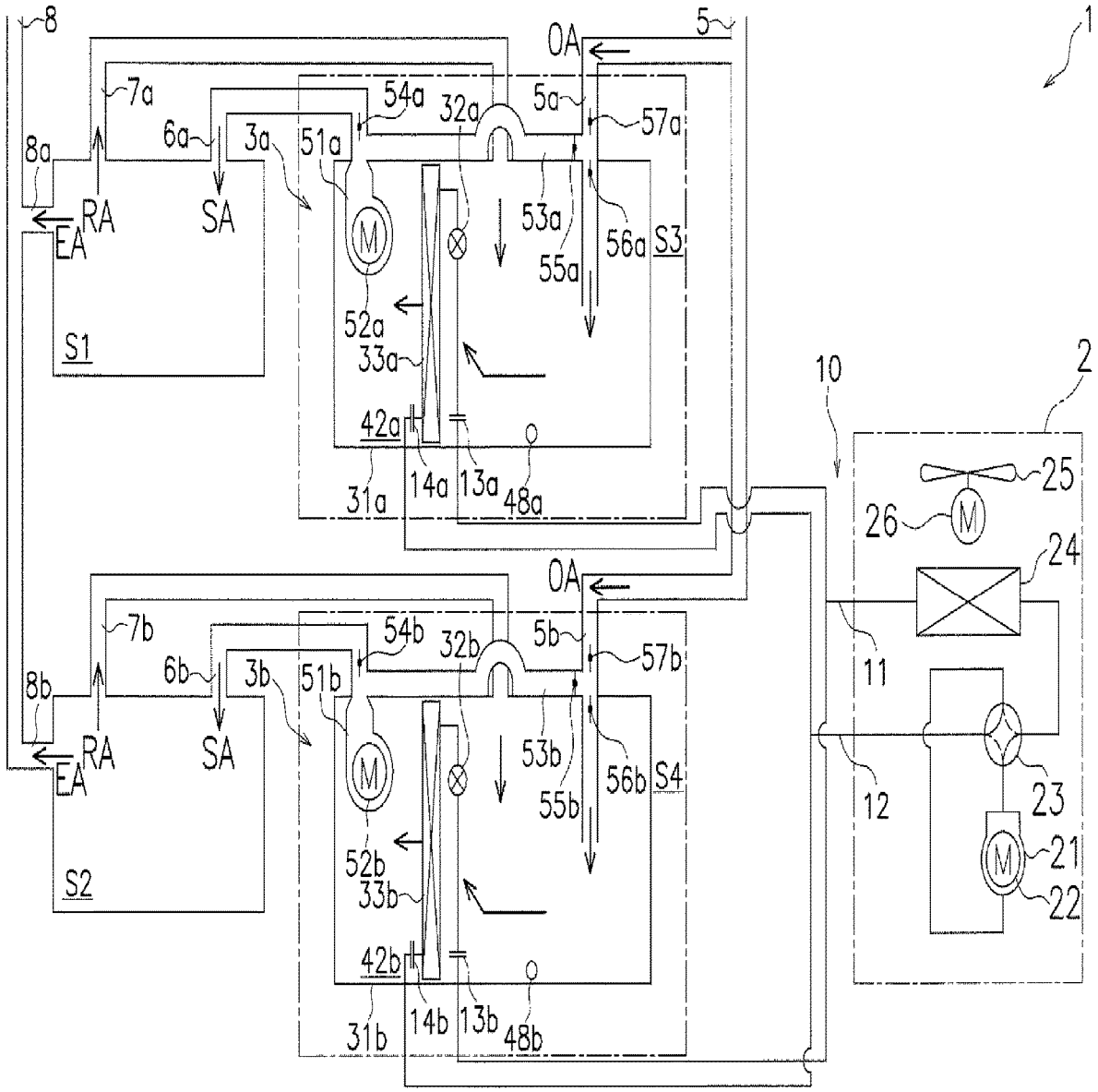
FIG. 6 is an overall configuration diagram of usage-side air-conditioning apparatuses according to a second embodiment of the present invention, and an air-conditioning apparatus provided with the same (the flow of air during normal operation and the like are also illustrated)
Figure 7:
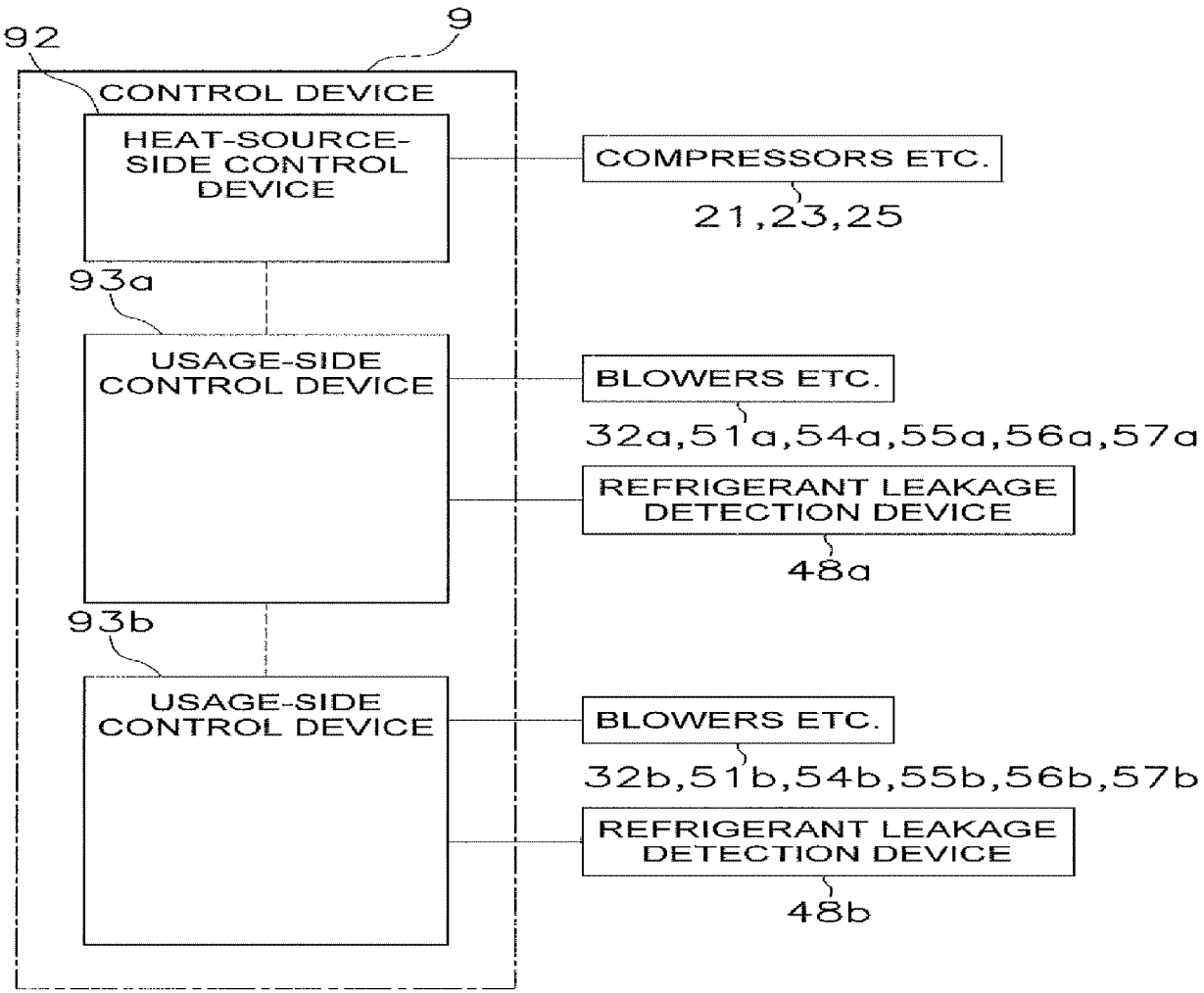
FIG. 7 is a control block diagram of the air-conditioning apparatus in the second embodiment.

FIG. 6 is an overall configuration diagram of usage-side air-conditioning apparatuses 3*a*, 3*b* according to a second embodiment of the present invention, and an air-conditioning apparatus 1 provided with the same. FIG. 7 is a control block diagram of the air-conditioning apparatus 1 in the second embodiment.

<Overall>

The air-conditioning apparatus 1, which is an air-conditioning ventilation system having a ventilating air-condition function for ventilating and air-conditioning the interior of a room, mainly has a heat-source-side air-conditioning apparatus 2, and a plurality (two in this embodiment) of usage-side air-conditioning apparatuses 3*a*, 3*b*.

The air-conditioning apparatus 1 has a refrigerant circuit 10 through which refrigerant circulates. The refrigerant circuit 10 is configured by connecting the heat-source-side air-conditioning apparatus 2 to the usage-side air-conditioning apparatuses 3*a*, 3*b*. In this embodiment, the heat-source-side air-conditioning apparatus 2 is installed in a location such as on the roof of a building, and the usage-side air-conditioning apparatuses 3*a*, 3*b* are installed in usage-side installation spaces (in this embodiment, usage-side installation spaces S3, S4), such as a machine room of the building or a space above the ceiling, in correspondence with air-conditioned spaces (in this embodiment, air-conditioned spaces S1, S2) that are ventilated and air-conditioned. The heat-source-side air-conditioning apparatus 2 and the usage-side air-conditioning apparatuses 3*a*, 3*b* are connected via refrigerant interconnection pipes 11, 12, thereby configuring the refrigerant circuit 10. The refrigerant sealed within the refrigerant circuit 10 is a slightly flammable refrigerant such as R32, a flammable refrigerant such as propane, or a toxic refrigerant such as ammonia.

The air-conditioning apparatus 1 has a plurality of air ducts. In this embodiment, the air-conditioning apparatus 1 has an intake duct 5 for taking outdoor air (OA) into the usage-side air-conditioning apparatuses 3*a*, 3*b* from outside the air-conditioned spaces 51, S2, air supply ducts 6*a*, 6*b* for supplying supply air (SA) from the usage-side air-conditioning apparatuses 3*a*, 3*b* to the air-conditioned spaces 51, S2, and outtake ducts 7*a*, 7*b* for taking room air (RA) from the air-conditioned spaces 51, S2 into the corresponding usage-side air-conditioning apparatuses 3*a*, 3*b*, whereby air can be exchanged between the air-conditioned spaces 51, S2 and/or the outsides of the air-conditioned spaces 51, S2 and the usage-side air-conditioning apparatuses 3*a*, 3*b*. Also connected to the air-conditioned spaces 51, S2 is an air exhaust duct 8 for exhausting exhaust air (EA) out of the air-conditioned spaces 51, S2. The intake duct 5 has intake branch ducts 5*a*, 5*b* that branch corresponding to the usage-side air-conditioning apparatuses 3*a*, 3*b*, and the air exhaust duct 8 has air exhaust branch ducts 8*a*, 8*b* that branch corresponding to the air-conditioned spaces 51, S2.

<Heat-Source-Side Air-Conditioning Apparatus>

The heat-source-side air-conditioning apparatus 2, as described above, is connected to the usage-side air-conditioning apparatuses 3*a*, 3*b* via the refrigerant interconnection pipes 11, 12, configuring part of the refrigerant circuit 10. The configuration of the heat-source-side air-conditioning apparatus 2 according to the present embodiment is similar to the configuration of the heat-source-side air-conditioning apparatus 2 of the first embodiment described above (see FIG. 1), and is therefore not described here.

<Usage-Side Air-Conditioning Apparatuses>

The usage-side air-conditioning apparatuses 3*a*, 3*b*, as described above, are connected to the heat-source-side air-conditioning apparatus 2 via the refrigerant interconnection pipes 11, 12, configuring part of the refrigerant circuit 10. Additionally, the usage-side air-conditioning apparatuses 3*a*, 3*b*, as described above, are designed so as to be able to exchange air with the air-conditioned spaces S1, S2 and/or the outsides of the air-conditioned spaces S1, S2 via the air ducts 5 (5*a*, 5*b*), 6*a*, 6*b*, 7*a*, 7*b*. In the following description, the configuration of the usage-side air-conditioning apparatus 3*a* is described, and description of the configuration of the usage-side air-conditioning apparatus 3*b*, in which the additional letter "a" is replaced by "b" for each component, is omitted.

The usage-side air-conditioning apparatus 3*a* mainly has a casing 31*a*, a usage-side expansion mechanism 32*a*, a usage-side heat exchanger 33*a*, an air supply/exhaust blower 51*a*, and a refrigerant leakage detection device 48*a*.

The casing 31*a* is installed in the usage-side installation space S3, and various ducts 5*a*, 6*a*, 7*a* are connected to the casing 31*a*. An air supply passage 42*a* to accommodate the usage-side heat exchanger 33*a* and the like is formed in the casing 31*a*.

The usage-side expansion mechanism 32*a* is an electric expansion valve that can, by performing opening degree control, vary the flow rate of the refrigerant flowing through the usage-side heat exchanger 33*a*. The usage-side expansion mechanism 32*a* is provided inside the casing 31*a* (inside the air supply passage 42*a* in this embodiment). One end of the usage-side expansion mechanism 32*a* is connected to a liquid side of the usage-side expansion mechanism 32*a*, and another end of the usage-side expansion mechanism 32*a* is connected to the liquid refrigerant interconnection pipe 11 via a joint 13*a*. The joint 13*a* is a pipe joint to connect the usage-side heat exchanger 33*a* to the refrigerant interconnection pipes 11, 12, and in this embodiment, is provided inside the casing 31*a* (inside the air supply passage 42*a* in this embodiment).

The usage-side heat exchanger 33*a* is a heat exchanger to cool or heat the air (RA and/or OA) in the casing 31*a* by means of the refrigerant supplied from the heat-source-side air-conditioning apparatus 2. The usage-side heat exchanger 33*a* is provided inside the casing 31*a* (inside the air supply passage 42*a* in this embodiment). The usage-side heat exchanger 33*a* is connected to the heat-source-side air-conditioning apparatus 2 via the refrigerant interconnection pipes 11, 12. A liquid side of the usage-side heat exchanger 33*a* is connected to the liquid refrigerant interconnection pipe 11 via the usage-side expansion mechanism 32*a* and the joint 13*a*, and a gas side of the usage-side heat exchanger 33*a* is connected to the gas refrigerant interconnection pipe 12 via a joint 14*a*. The joint 14*a* is a pipe joint to connect the usage-side heat exchanger 33*a* to the gas refrigerant interconnection pipe 12, and in this embodiment, is provided inside the casing 31*a* (inside the air supply passage 42*a* in this embodiment).

The air supply/exhaust blower 51*a* is a fan provided to be capable of switching between an air supply state of taking room air (RA) in from the air-conditioned space S1, taking outdoor air (OA) in from outside the air-conditioned space S1, and supplying supply air (SA) to the air-conditioned space S1, and an air exhaust state of exhausting exhaust air (EA) out of the air-conditioned space S1. The air supply/exhaust blower 51*a* is provided inside the air supply passage 42*a*, and an outlet of this blower is connected to the air supply duct 6*a*. The air supply/exhaust blower 51*a* is designed to be driven by an air supply/exhaust blower motor 52*a*. An air supply prevention mechanism 54*a* composed of an air damper is provided to the outlet of the air supply/exhaust blower 51*a*. The air damper of the air supply prevention mechanism 54*a* is opened when the air supply/exhaust blower 51*a* is operated in the air supply state, and closed when the air supply/exhaust blower 51*a* is operated in the air exhaust state. The air supply prevention mechanism 54*a* may be provided to the air supply duct 6*a* rather than to the outlet of the air supply/exhaust blower 51*a*. One end of a bypass passage 53*a* is connected to the outlet of the air supply/exhaust blower 51*a* in a position on an upstream side of the air supply prevention mechanism 54*a*. Another end of the bypass passage 53*a* is connected to an inlet for outdoor air (OA) in the casing 31*a*. A bypass opening/closing mechanism 55*a* composed of an air damper is provided to the bypass passage 53*a*. The air damper of the bypass opening/closing mechanism 55*a* is closed when the air supply/exhaust blower 51*a* is operated in the air supply state, and is opened when the air supply/exhaust blower 51*a* is operated in the air exhaust state. The bypass passage 53*a* including the bypass opening/closing mechanism 55*a*, rather than connecting between the outlet of the air supply/exhaust blower 51*a* and the inlet for outdoor air (OA) of the casing 31*a*, may be provided so as to connect between the air supply duct 6*a* and the intake duct 5 (5*a*). An intake prevention mechanism 56*a* composed of an air damper is provided to the inlet for outdoor air (OA) of the casing 31*a* in a position nearer to the air supply passage 42*a* than the position where the other end of the bypass passage 53*a* is connected. The air damper of the intake prevention mechanism 56*a* is opened when the air supply/exhaust blower 51*a* is operated in the air supply state, and closed when the air supply/exhaust blower 51*a* is operated in the air exhaust state. An air return regulation mechanism 57*a* composed of an air damper is provided to the inlet for outdoor air (OA) of the casing 31*a* in a position nearer to the intake duct 5 (5*a*) than the position where the other end of the bypass passage 53*a* is connected. The intake prevention mechanism 56*a* and the air return regulation mechanism 57*a* may be provided to the intake branch duct 5*a* rather than the inlet for outdoor air (OA) of the casing 31*a*. Thus, the air supply/exhaust blower 51*a* can be switched between operating in the air supply state and the air exhaust state by the bypass passage 53*a*, the air supply prevention mechanism 54*a*, the bypass opening/closing mechanism 55*a*, and the intake prevention mechanism 56*a*. Specifically, the air supply/exhaust blower 51*a* can be operated in the air supply state by opening the air supply prevention mechanism 54*a* and the intake prevention mechanism 56*a* and closing the bypass opening/closing mechanism 55*a*, and the air supply/exhaust blower 51*a* can be operated in the air exhaust state by closing the air supply prevention mechanism 54*a* and the intake prevention mechanism 56*a* and opening the bypass opening/closing mechanism 55*a*.

The above-described air passages 42*a*, 53*a*, mechanisms 54*a*, 55*a*, 56*a*, 57*a*, and blower 51*a*, when connected with the air ducts 5 (5*a*), 6*a*, 6*b*, 7*a*, 7*b*, configure an air supply/exhaust mechanism of the usage-side air-conditioning apparatus 3*a* to take room air (RA) into the casing 31*a* from the air-conditioned space 51, take outdoor air (OA) into the casing 31*a* from outside the air-conditioned space 51, supply the air inside the casing 31*a* as supply air (SA) to the air-conditioned space 51, and exhaust the air inside the casing 31*a* as exhaust air (EA) out of the air-conditioned space 51.

The refrigerant leakage detection device 48*a* is a device to detect refrigerant. The refrigerant leakage detection device 48*a* is provided inside the casing 31*a*. In this embodiment, the refrigerant leakage detection device 48*a* is provided inside the air supply passage 42*a* in which the usage-side heat exchanger 33*a* (in this embodiment, the joints 13*a*, 14*a* and/or the usage-side expansion mechanism 32*a*) is placed. Furthermore, in this embodiment, the refrigerant leakage detection device 48*a* is provided either to a lower part (when the refrigerant is denser than air) of the casing 31*a* (in this embodiment, the air supply passage 42*a*) or an upper part (when the refrigerant is less dense than air) of the casing 31*a* (in this embodiment, the air supply passage 42*a*). FIG. 6 shows a case in which the refrigerant leakage detection device 48*a* is provided to the lower part of the casing 31*a*.

<Control Device>

The air-conditioning apparatus 1 has a control device 9 to perform operation control on the heat-source-side air-conditioning apparatus 2 and the usage-side air-conditioning apparatuses 3*a*, 3*b*, etc. The control device 9 mainly has a heat-source-side control device 92 to control the actions of the components (compressor, etc.) configuring the heat-source-side air-conditioning apparatus 2, and usage-side control devices 93*a*, 93*b* to control the actions of the components (fans, refrigerant leakage detection devices, etc.) configuring the usage-side air-conditioning apparatuses 3*a*, 3*b*. The heat-source-side control device 92, which is provided to the heat-source-side air-conditioning apparatus 2, has a microcomputer and/or a memory, etc. for performing control on the heat-source-side air-conditioning apparatus 2. The usage-side control devices 93*a*, 93*b*, which are provided to the usage-side air-conditioning apparatuses 3*a*, 3*b*, have microcomputers and/or memories, etc. for performing control on the usage-side air-conditioning apparatuses 3*a*, 3*b*. The heat-source-side control device 92 and the usage-side control devices 93*a*, 93*b* are connected so as to be capable of exchanging, for example, control signals via a transmission line, and the control device 9 of the air-conditioning apparatus 1 is thereby configured. In this embodiment, the control devices 92, 93*a*, 93*b* are connected via a transmission line, but are not limited to being connected in this manner and may be connected wirelessly or by another connection method.

(2) Actions

In the air-conditioning apparatus 1 having the configuration described above, the following operations are performed. Operation controls of the air-conditioning apparatus 1 described below are performed by the control device 9.

<Normal Operation>

In normal operation, an operation is performed such that the outdoor air (OA) is taken into the casings 31*a*, 31*b* from outside the air-conditioned spaces S1, S2, room air (RA) is taken into the casings 31*a*, 31*b* from the air-conditioned spaces 51, S2, and the air is cooled or heated in the usage-side heat exchangers 33*a*, 33*b* and then supplied as supply air (SA) to the air-conditioned spaces 51, S2, as shown in FIG. 6. In this embodiment, exhaust air (EA) is exhausted out of the air-conditioned spaces 51, S2 through the air exhaust duct 8 (8*a*, 8*b*) connected to the air-conditioned spaces 51, S2. Specifically, operation control such as the following is performed on the components of the air-conditioning apparatus 1.

When air is supplied as supply air (SA) to the air-conditioned spaces 51, S2 after being cooled in the usage-side heat exchangers 33*a*, 33*b*, in the heat-source-side air-conditioning apparatus 2, the switching mechanism 23 is switched to the air-cooling operation state (the state shown by the solid lines of the switching mechanism 23 in FIG. 6), and the compressor 21 and the heat-source-side fan 25 are driven. When air is supplied as supply air (SA) to the air-conditioned spaces 51, S2 after being heated in the usage-side heat exchangers 33*a*, 33*b*, in the heat-source-side air-conditioning apparatus 2, the switching mechanism 23 is switched to the air-warming operation state (the state shown by the dashed lines of the switching mechanism 23 in FIG. 6), and the compressor 21 and the heat-source-side fan 25 are driven. In this embodiment, the actions of the components of the refrigerant circuit 10 etc. are the same as the actions of the components of the refrigerant circuit 10, etc. of the first embodiment and are therefore not described here.

In the usage-side air-conditioning apparatuses 3*a*, 3*b* at this time, the air supply prevention mechanisms 54*a*, 54*b*, the intake prevention mechanisms 56*a*, 56*b*, and the air return regulation mechanisms 57*a*, 57*b* are opened, the bypass opening/closing mechanism 55*a* is closed, and the air supply/exhaust blowers 51*a*, 51*b* are driven. Specifically, the air supply/exhaust blowers 51*a*, 51*b* are operated in the air supply state. Due to these actions, outdoor air (OA) is taken into the air supply passages 42*a*, 42*b* of the casings 31*a*, 31*b* from outside the air-conditioned spaces 51, S2 through the intake duct 5 (5*a*, 5*b*), and room air (RA) is taken into the air supply passages 42*a*, 42*b* of the casings 31*a*, 31*b* from the air-conditioned spaces 51, S2 through the outtake ducts 7*a*, 7*b*. The outdoor air (OA) and the room air (RA) taken into the casings 31*a*, 31*b* is cooled or heated in the usage-side heat exchangers 33*a*, 33*b* by refrigerant supplied from the heat-source-side air-conditioning apparatus 2 through the liquid refrigerant interconnection pipe 11. Having been cooled or heated in the usage-side heat exchangers 33*a*, 33*b*, the outdoor air (OA) or the outdoor air (OA) including room air (RA) is supplied as supply air (SA) to the air-conditioned spaces S1, S2 through the air supply/exhaust blowers 51*a*, 51*b* and the air supply ducts 6*a*, 6*b*. In this embodiment, the opening degrees of the air return regulation mechanisms 57*a*, 57*b* may be adjusted to control the amount of outdoor air (OA) taken in.

<Refrigerant Exhaust Operation>

During the normal operation described above, when refrigerant leaks in the usage-side air-conditioning apparatuses 3*a*, 3*b*, the leaked refrigerant is supplied to the air-conditioned spaces S1, S2, and there is a risk of ignition accidents (when the refrigerant is slightly flammable or flammable) or poisoning accidents (when the refrigerant is toxic) occurring. In view of this, when the refrigerant leakage detection devices 48*a*, 48*b* detect refrigerant, a refrigerant exhaust operation is performed to exhaust refrigerant together with the air in the casings 31*a*, 31*b* out of the air-conditioned spaces S1, S2, by means of the air supply/exhaust mechanisms. In this embodiment, the refrigerant exhaust operation is performed by operating the air supply/exhaust blowers 51*a*, 51*b* configuring the air supply/exhaust mechanisms in the air exhaust state.

Figure 8:
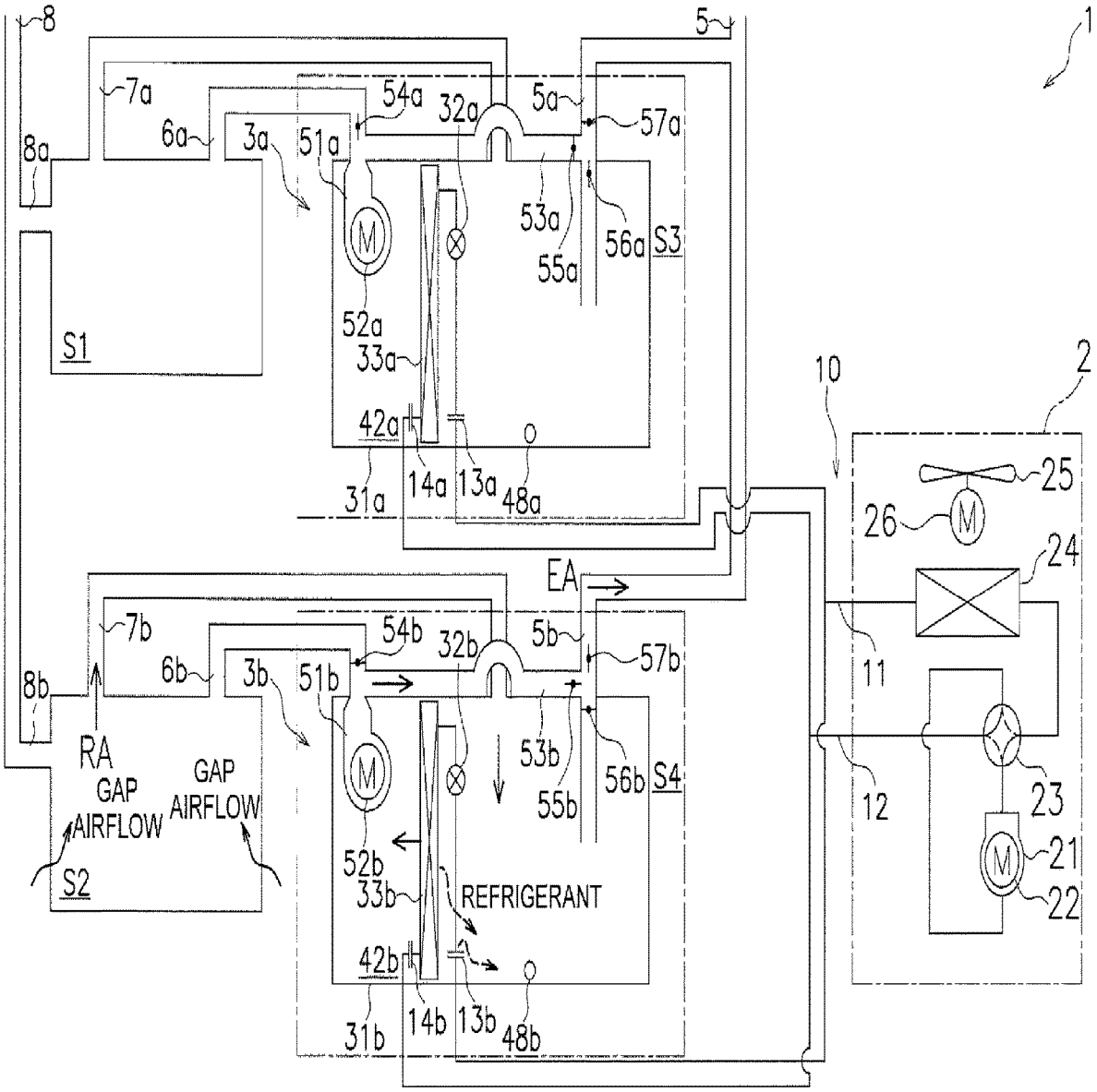
FIG. 8 is a diagram showing air flow during a refrigerant exhaust operation and the like in the second embodiment.

For example, supposing a case in which refrigerant has leaked in the usage-side air-conditioning apparatus 3*b* (i.e., the refrigerant leakage detection device 48*b* has detected refrigerant), the air supply/exhaust blower 51*b* is operated in the air exhaust state in the usage-side air-conditioning apparatus 3*b* as shown in FIG. 8. Specifically, the air supply prevention mechanism 54*b* and the intake prevention mechanism 56*b* are closed, the bypass opening/closing mechanism 55*b* is opened, and the air supply/exhaust blower 51*b* is operated. The leaked refrigerant, along with the air in the casing 31*b*, is thereby passed through the bypass passage 53*b* and exhausted to the intake duct 5 (5*b*). In this embodiment, when the air supply/exhaust blower 51*b* is operated in the air exhaust state, room air (RA) is taken into the casing 31*b* from the air-conditioned space S2, and this room air (RA) is therefore exhausted to the intake duct 5 (5*b*) along with the leaked refrigerant. At this time, outdoor air (OA) is taken into the casing 31*b* along with room air (RA), from outside the air-conditioned space S2 through the air exhaust duct 8 (8*b*). In the heat-source-side air-conditioning apparatus 2, refrigerant is prevented from being supplied from the heat-source-side air-conditioning apparatus 2 to the usage-side air-conditioning apparatus 3*b*, for example, due to the compressor 21 being stopped. In the usage-side air-conditioning apparatus 3*a*, in which refrigerant is not leaking, the refrigerant that leaked in the usage-side air-conditioning apparatus 3*b* is prevented from flowing back to the casing 31*a* through the intake duct 5 (5*a*) by closing the air return regulation mechanism 57*a*.

(3) Characteristics

The usage-side air-conditioning apparatuses 3*a*, 3*b* of the present embodiment and the air-conditioning apparatus 1 provided with the same have characteristics such as the following.

In this embodiment, as described above, in the usage-side air-conditioning apparatuses 3*a*, 3*b* having the ventilating air-condition function and the air-conditioning apparatus 1 provided with the same, when the refrigerant leakage detection devices 48*a*, 48*b* detect refrigerant, the refrigerant exhaust operation is performed by the air supply/exhaust mechanisms to exhaust the refrigerant along with the air in the casings 31*a*, 31*b* out of the air-conditioned spaces S1, S2. Particularly, in this embodiment, the refrigerant exhaust operation is performed by operating the air supply/exhaust blowers 51*a*, 51*b* in the air exhaust state. Additionally, in this embodiment, the air-conditioning apparatus 1 is configured by connecting the heat-source-side air-conditioning apparatus 2 and the plurality (two in this embodiment) of usage-side air-conditioning apparatuses 3*a*, 3*b*.

In this embodiment, when refrigerant leaks, it is thereby possible to ensure that the leaked refrigerant is quickly exhausted and not supplied to the air-conditioned spaces S1, S2, using the air supply/exhaust mechanisms (in this embodiment, by operating the air supply/exhaust blowers 51*a*, 51*b* in the air exhaust state). Additionally, in this embodiment, when refrigerant has leaked in any of the plurality of usage-side air-conditioning apparatuses 3*a*, 3*b*, it is possible to ensure that the leaked refrigerant is quickly exhausted using the air supply/exhaust mechanism of the usage-side air-conditioning apparatus 3*a* or 3*b* in which the refrigerant has leaked, and that the refrigerant is not supplied to the air-conditioned space S1 or S2 that is being air-conditioned by the usage-side air-conditioning apparatus 3*a* or 3*b* in which the refrigerant has leaked.

When the refrigerant is slightly flammable or flammable, the occurrence of ignition accidents in the air-conditioned spaces S1, S2 can be suppressed. When the refrigerant is toxic, the occurrence of poisoning accidents in the air-conditioned spaces S1, S2 can be suppressed. The occurrence of oxygen deficiency accidents in the air-conditioned spaces S1, S2 can be suppressed even when the refrigerant is not slightly flammable, flammable, or toxic.

This embodiment also has the characteristics <B> and <C> of the first embodiment.

(4) Modifications

In the above-described usage-side air-conditioning apparatuses 3*a*, 3*b* and the air-conditioning apparatus 1 provided with the same (see FIGS. 6 to 8), the joints 13*a*, 13*b*, 14*a*, 14*b* connecting the usage-side heat exchangers 33*a*, 33*b* to the refrigerant interconnection pipes are provided inside the casings 31*a*, 31*b*, but there are also cases in which the joints 13*a*, 13*b*, 14*a*, 14*b* are provided outside of the casings 31*a*, 31*b*, similar to the usage-side air-conditioning apparatuses 3*a*, 3*b* of the first embodiment (FIG. 4). In these cases, when refrigerant leaks from the joints 13*a*, 13*b*, 14*a*, 14*b*, the leakage occurs in the usage-side installation spaces S3, S4 in which the casings 31*a*, 31*b* of the usage-side air-conditioning apparatuses 3*a*, 3*b* are installed.

In view of this, in the above-described usage-side air-conditioning apparatuses 3*a*, 3*b* and the air-conditioning apparatus 1 provided with the same (see FIGS. 6 to 8), the usage-side air-conditioning apparatuses 3*a*, 3*b*, similar to the usage-side air-conditioning apparatuses 3*a*, 3*b* according to the modification of the first embodiment, are provided with inside-outside communication mechanisms 47*a*, 47*b*, which are capable of switching between an inside-outside communication state of allowing the usage-side installation spaces S3, S4 and the interiors of the casings 31*a*, 31*b* to communicate, and an inside-outside non-communication state of not allowing the usage-side installation spaces S3, S4 and the interiors of the casings 31*a*, 31*b* to communicate, the refrigerant exhaust operation being performed by putting the inside-outside communication mechanisms 47*a*, 47*b* in the inside-outside communication state.

Additionally, in the above-described usage-side air-conditioning apparatuses 3*a*, 3*b* and the air-conditioning apparatus 1 provided with the same (see FIGS. 6 to 8), the intake duct 5 (5*a*, 5*b*) is used to exhaust leaked liquid refrigerant during the refrigerant exhaust operation, but when a separate duct is connected to the casings 31*a*, 31*b*, this separate duct may be used for leaked refrigerant during the refrigerant exhaust operation. In this case, outdoor air (OA) may continue to be taken into the casings 31*a*, 31*b* through the intake duct 5 (5*a*, 5*b*) during the refrigerant exhaust operation as well.

Third Embodiment

(1) Configuration

Figure 9:
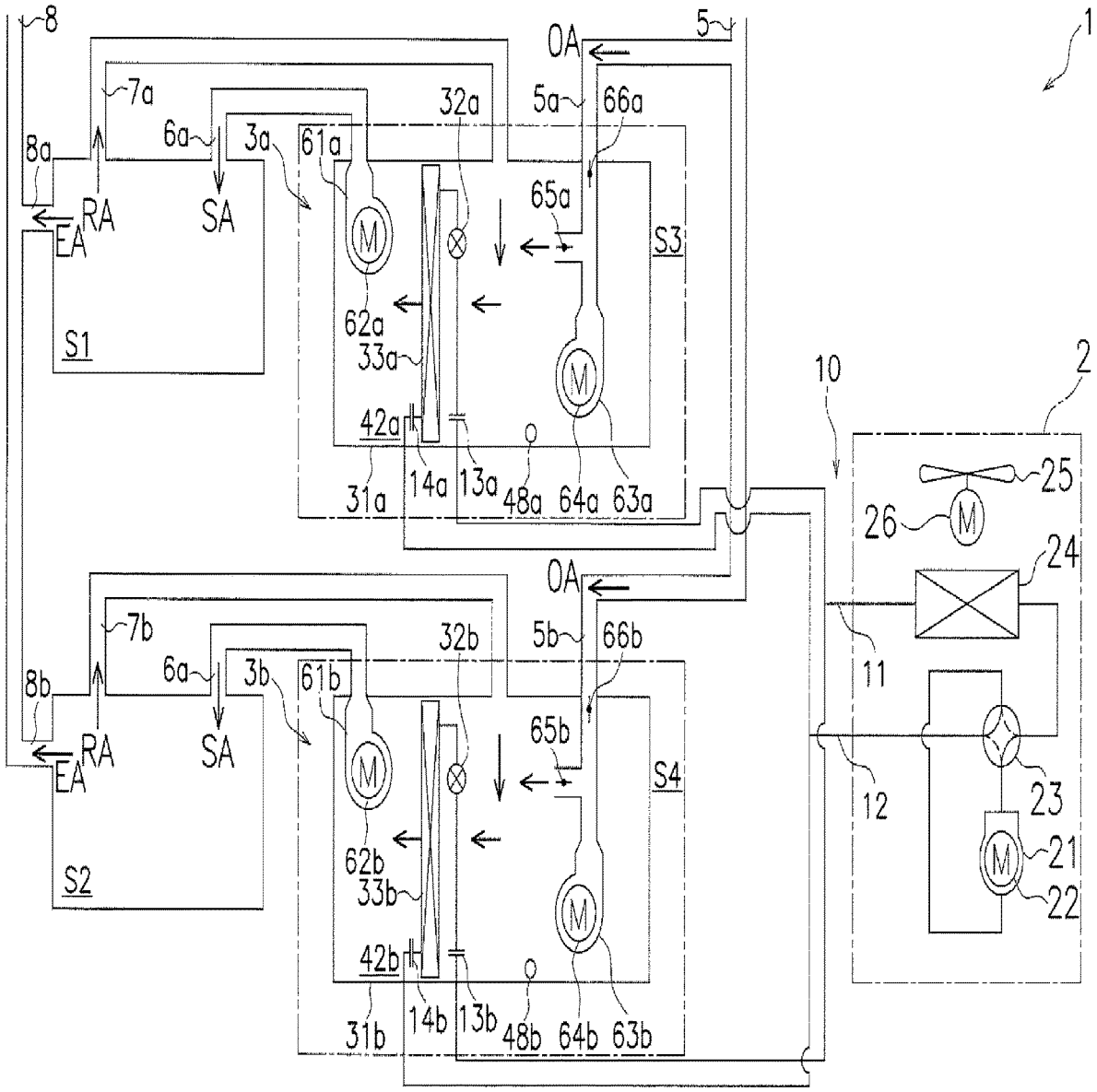
FIG. 9 is an overall configuration diagram of usage-side air-conditioning apparatuses according to a third embodiment of the present invention, and an air-conditioning apparatus provided with the same (the flow of air during normal operation and the like are also illustrated)
Figure 10:
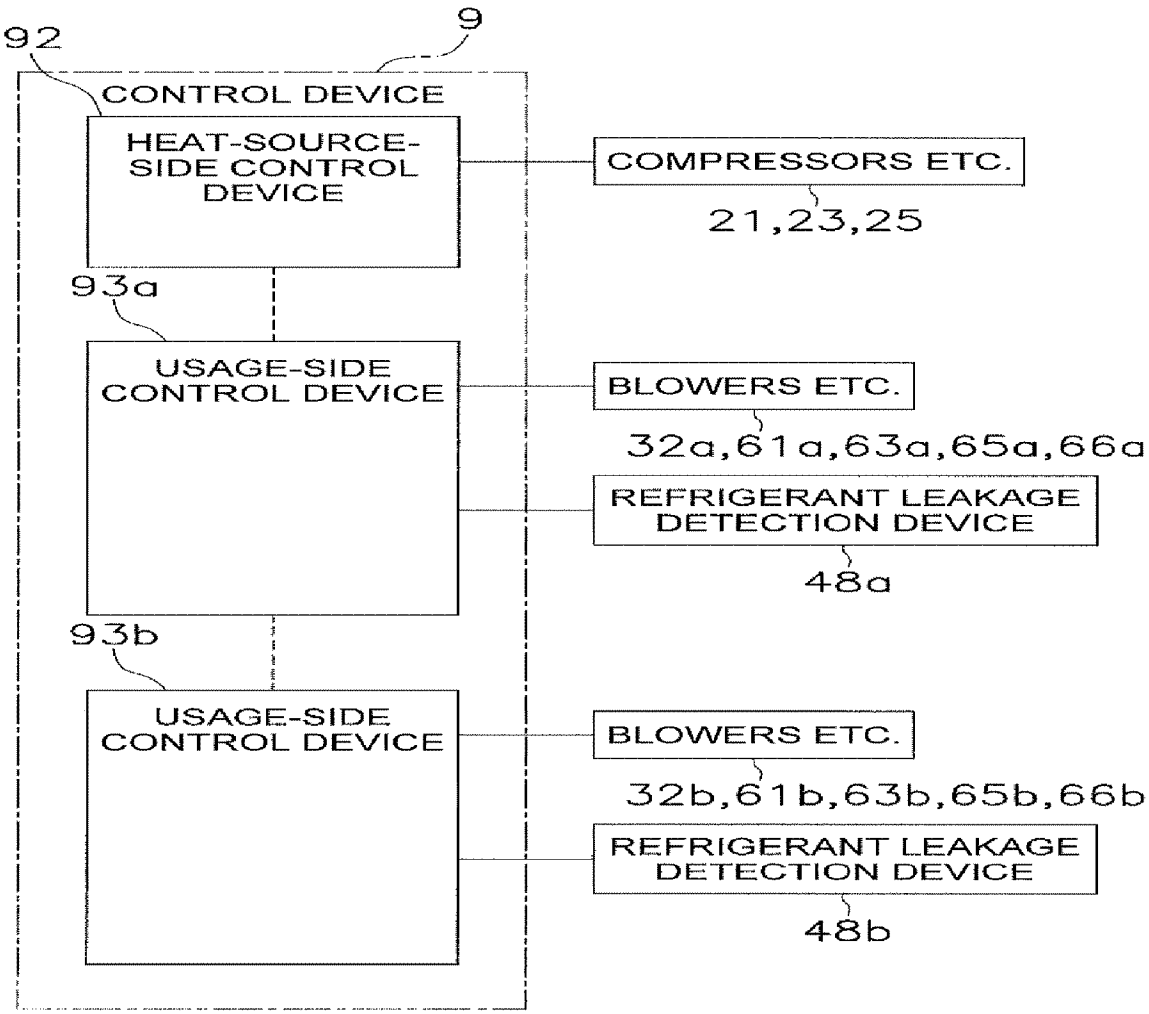
FIG. 10 is a control block diagram of the air-conditioning apparatus in the third embodiment.

FIG. 9 is an overall configuration diagram of usage-side air-conditioning apparatuses 3*a*, 3*b* according to a third embodiment of the present invention, and an air-conditioning apparatus 1 provided with the same. FIG. 10 is a control block diagram of the air-conditioning apparatus 1 in the third embodiment.

<Overall>

The air-conditioning apparatus 1, which is an air-conditioning ventilation system having a ventilating air-condition function for ventilating and air-conditioning the interior of a room, mainly has a heat-source-side air-conditioning apparatus 2, and a plurality (two in this embodiment) of usage-side air-conditioning apparatuses 3*a*, 3*b*.

The air-conditioning apparatus 1 has a refrigerant circuit 10 through which refrigerant circulates. The refrigerant circuit 10 is configured by connecting the heat-source-side air-conditioning apparatus 2 to the usage-side air-conditioning apparatuses 3*a*, 3*b*. In this embodiment, the heat-source-side air-conditioning apparatus 2 is installed in a location such as on the roof of a building, and the usage-side air-conditioning apparatuses 3*a*, 3*b* are installed in usage-side installation spaces (in this embodiment, usage-side installation spaces S3, S4), such as a machine room of the building or a space above the ceiling, in correspondence with air-conditioned spaces (in this embodiment, air-conditioned spaces 51, S2) that are ventilated and air-conditioned. The heat-source-side air-conditioning apparatus 2 and the usage-side air-conditioning apparatuses 3*a*, 3*b* are connected via refrigerant interconnection pipes 11, 12, thereby configuring the refrigerant circuit 10. The refrigerant sealed within the refrigerant circuit 10 is a slightly flammable refrigerant such as R32, a flammable refrigerant such as propane, or a toxic refrigerant such as ammonia.

The air-conditioning apparatus 1 has a plurality of air ducts. In this embodiment, the air-conditioning apparatus 1 has an intake duct 5 for taking outdoor air (OA) into the usage-side air-conditioning apparatuses 3*a*, 3*b* from outside the air-conditioned spaces S1, S2, air supply ducts 6*a*, 6*b* for supplying supply air (SA) from the usage-side air-conditioning apparatuses 3*a*, 3*b* to the air-conditioned spaces S1, S2, and outtake ducts 7*a*, 7*b* for taking room air (RA) from the air-conditioned spaces S1, S2 into the corresponding usage-side air-conditioning apparatuses 3*a*, 3*b*, whereby air can be exchanged between the air-conditioned spaces S1, S2 and/or the outsides of the air-conditioned spaces S1, S2 and the usage-side air-conditioning apparatuses 3*a*, 3*b*. Also connected to the air-conditioned spaces S1, S2 is an air exhaust duct 8 for exhausting exhaust air (EA) out of the air-conditioned spaces S1, S2. The intake duct 5 has intake branch ducts 5*a*, 5*b* that branch corresponding to the usage-side air-conditioning apparatuses 3*a*, 3*b*, and the air exhaust duct 8 has air exhaust branch ducts 8*a*, 8*b* that branch corresponding to the air-conditioned spaces S1, S2.

<Heat-Source-Side Air-Conditioning Apparatus>

The heat-source-side air-conditioning apparatus 2, as described above, is connected to the usage-side air-conditioning apparatuses 3*a*, 3*b* via the refrigerant interconnection pipes 11, 12, configuring part of the refrigerant circuit 10. The configuration of the heat-source-side air-conditioning apparatus 2 according to the present embodiment is similar to the configuration of the heat-source-side air-conditioning apparatus 2 of the first embodiment described above (see FIG. 1), and is therefore not described here.

<Usage-Side Air-Conditioning Apparatuses>

The usage-side air-conditioning apparatuses 3*a*, 3*b*, as described above, are connected to the heat-source-side air-conditioning apparatus 2 via the refrigerant interconnection pipes 11, 12, configuring part of the refrigerant circuit 10. Additionally, the usage-side air-conditioning apparatuses 3*a*, 3*b*, as described above, are designed so as to be able to exchange air with the air-conditioned spaces S1, S2 and/or the outsides of the air-conditioned spaces S1, S2 via the air ducts 5 (5*a*, 5*b*), 6*a*, 6*b*, 7*a*, 7*b*. In the following description, the configuration of the usage-side air-conditioning apparatus 3*a* is described, and description of the configuration of the usage-side air-conditioning apparatus 3*b*, in which the additional letter "a" is replaced by "b" for each component, is omitted.

The usage-side air-conditioning apparatus 3*a* mainly has a casing 31*a*, a usage-side expansion mechanism 32*a*, a usage-side heat exchanger 33*a*, a second air supply blower 61*a*, a second air exhaust blower 63*a*, and a refrigerant leakage detection device 48*a*.

The casing 31*a* is installed in the usage-side installation space S3, and various ducts 5*a*, 6*a*, 7*a* are connected to the casing 31*a*. An air supply passage 42*a* to accommodate the usage-side heat exchanger 33*a* and the like is formed in the casing 31*a*.

The usage-side expansion mechanism 32*a* is an electric expansion valve that can, by performing opening degree control, vary the flow rate of the refrigerant flowing through the usage-side heat exchanger 33*a*. The usage-side expansion mechanism 32*a* is provided inside the casing 31*a* (inside the air supply passage 42*a* in this embodiment). One end of the usage-side expansion mechanism 32*a* is connected to a liquid side of the usage-side expansion mechanism 32*a*, and another end of the usage-side expansion mechanism 32*a* is connected to the liquid refrigerant interconnection pipe 11 via a joint 13*a*. The joint 13*a* is a pipe joint to connect the usage-side heat exchanger 33*a* to the refrigerant interconnection pipes 11, 12, and in this embodiment, is provided inside the casing 31*a* (inside the air supply passage 42*a* in this embodiment).

The usage-side heat exchanger 33*a* is a heat exchanger to cool or heat the air (RA and/or OA) in the casing 31*a* by means of the refrigerant supplied from the heat-source-side air-conditioning apparatus 2. The usage-side heat exchanger 33*a* is provided inside the casing 31*a* (inside the air supply passage 42*a* in this embodiment). The usage-side heat exchanger 33*a* is connected to the heat-source-side air-conditioning apparatus 2 via the refrigerant interconnection pipes 11, 12. A liquid side of the usage-side heat exchanger 33*a* is connected to the liquid refrigerant interconnection pipe 11 via the usage-side expansion mechanism 32*a* and the joint 13*a*, and a gas side of the usage-side heat exchanger 33*a* is connected to the gas refrigerant interconnection pipe 12 via a joint 14*a*. The joint 14*a* is a pipe joint to connect the usage-side heat exchanger 33*a* to the gas refrigerant interconnection pipe 12, and in this embodiment, is provided inside the casing 31*a* (inside the air supply passage 42*a* in this embodiment).

The second air supply blower 61*a* is a fan provided to be capable of taking room air (RA) in from the air-conditioned space S1, taking outdoor air (OA) in from outside the air-conditioned space S1, and supplying supply air (SA) to the air-conditioned space S1. The second air supply blower 61*a* is provided inside the air supply passage 42*a*, and an outlet of this blower is connected to the air supply duct 6*a*. The second air supply blower 61*a* is designed to be driven by a second air supply blower motor 62*a*.

The second air exhaust blower 63*a* is a fan provided so as to be able to exhaust the exhaust air (EA) out of the air-conditioned space S1. The second air exhaust blower 63*a* is provided inside the air supply passage 42*a*, and an outlet of this blower is connected to an inlet for outdoor air (OA) of the casing 31*a*. The second air exhaust blower 63*a* is designed to be driven by a second air exhaust blower motor 64*a*. Additionally, an air exhaust outlet communication mechanism 65*a*, which is composed of a communication path to allow communication between the air supply passage 42*a* and the outlet of the second air exhaust blower 63*a* and an air damper placed in this communication path, is provided to the outlet of the second air exhaust blower 63*a*. The air exhaust outlet communication mechanism 65*a* is capable of switching between an outside air intake state of allowing the inlet for outdoor air (OA) of the casing 31*a* to communicate with the air supply passage 42*a* and enabling outdoor air (OA) to be taken in from outside the air-conditioned space S1 by opening the air damper, and an air exhaust state of allowing the outlet of the second air exhaust blower 63*a* to communicate with the inlet for outdoor air (OA) of the casing 31*a* and enabling exhaust air (EA) to be exhausted out of the air-conditioned space S1 by closing the air damper. Additionally, an air return regulation mechanism 66*a* composed of an air damper is provided to the inlet for outdoor air (OA) of the casing 31*a*. The air return regulation mechanism 66*a* may be provided to the intake branch duct 5*a* rather than the inlet for outdoor air (OA) of the casing 31*a*. Thus, by operating while the second air exhaust blower 63*a* is stopped and the air exhaust outlet communication mechanism 65*a* is in the outside air intake state, the second air supply blower 61*a* is able to take room air (RA) in from the air-conditioned space S1, take outdoor air (OA) in from outside the air-conditioned space S1, and supply the air-conditioned space S1 with supply air (SA). Additionally, the second air exhaust blower 63*a* is able to exhaust the exhaust air (EA) out of the air-conditioned space S1 by operating with the air exhaust outlet communication mechanism 65*a* in the air exhaust state.

The above-described air passage 42*a*, mechanisms 65*a*, 66*a*, and blowers 61*a*, 63*a*, when connected with the air ducts 5 (5*a*), 6*a*, 6*b*, 7*a*, 7*b*, configure an air supply/exhaust mechanism of the usage-side air-conditioning apparatus 3*a* to take room air (RA) into the casing 31*a* from the air-conditioned space S1, take outdoor air (OA) into the casing 31*a* from outside the air-conditioned space S1, supply the air inside the casing 31*a* as supply air (SA) to the air-conditioned space S1, and exhaust the air inside the casing 31*a* as exhaust air (EA) out of the air-conditioned space S1.

The refrigerant leakage detection device 48*a* is a device to detect refrigerant. The refrigerant leakage detection device 48*a* is provided inside the casing 31*a*. In this embodiment, the refrigerant leakage detection device 48*a* is provided inside the air supply passage 42*a* in which the usage-side heat exchanger 33*a* (in this embodiment, the joints 13*a*, 14*a* and/or the usage-side expansion mechanism 32*a*) is placed. Furthermore, in this embodiment, the refrigerant leakage detection device 48*a* is provided either to a lower part (when the refrigerant is denser than air) of the casing 31*a* (in this embodiment, the air supply passage 42*a*) or an upper part (when the refrigerant is less dense than air) of the casing 31*a* (in this embodiment, the air supply passage 42*a*). FIG. 9 shows a case in which the refrigerant leakage detection device 48*a* is provided to the lower part of the casing 31*a*.

<Control Device>

The air-conditioning apparatus 1 has a control device 9 to perform operation control on the heat-source-side air-conditioning apparatus 2 and the usage-side air-conditioning apparatuses 3*a*, 3*b*, etc. The control device 9 mainly has a heat-source-side control device 92 to control the actions of the components (compressor, etc.) configuring the heat-source-side air-conditioning apparatus 2, and usage-side control devices 93*a*, 93*b* to control the actions of the components (fans, refrigerant leakage detection devices, etc.) configuring the usage-side air-conditioning apparatuses 3*a*, 3*b*. The heat-source-side control device 92, which is provided to the heat-source-side air-conditioning apparatus 2, has a microcomputer and/or a memory, etc. for performing control on the heat-source-side air-conditioning apparatus 2. The usage-side control devices 93*a*, 93*b*, which are provided to the usage-side air-conditioning apparatuses 3*a*, 3*b*, have microcomputers and/or memories, etc. for performing control on the usage-side air-conditioning apparatuses 3*a*, 3*b*. The heat-source-side control device 92 and the usage-side control devices 93*a*, 93*b* are connected so as to be capable of exchanging, for example, control signals via a transmission line, and the control device 9 of the air-conditioning apparatus 1 is thereby configured. In this embodiment, the control devices 92, 93*a*, 93*b* are connected via a transmission line, but are not limited to being connected in this manner and may be connected wirelessly or by another connection method.

(2) Actions

In the air-conditioning apparatus 1 having the configuration described above, the following operations are performed. Operation controls of the air-conditioning apparatus 1 described below are performed by the control device 9.

<Normal Operation>

In normal operation, an operation is performed such that outdoor air (OA) is taken into the casings 31*a*, 31*b* from outside the air-conditioned spaces S1, S2, room air (RA) is taken into the casings 31*a*, 31*b* from the air-conditioned spaces 51, S2, and the air is cooled or heated in the usage-side heat exchangers 33*a*, 33*b* and then supplied as supply air (SA) to the air-conditioned spaces 51, S2, as shown in FIG. 9. In this embodiment, exhaust air (EA) is exhausted out of the air-conditioned spaces S1, S2 through the air exhaust duct 8 (8*a*, 8*b*) connected to the air-conditioned spaces S1, S2. Specifically, operation control such as the following is performed on the components of the air-conditioning apparatus 1.

When air is supplied as supply air (SA) to the air-conditioned spaces S1, S2 after being cooled in the usage-side heat exchangers 33*a*, 33*b*, in the heat-source-side air-conditioning apparatus 2, the switching mechanism 23 is switched to the air-cooling operation state (the state shown by the solid lines of the switching mechanism 23 in FIG. 9), and the compressor 21 and the heat-source-side fan 25 are driven. When air is supplied as supply air (SA) to the air-conditioned spaces S1, S2 after being heated in the usage-side heat exchangers 33*a*, 33*b*, in the heat-source-side air-conditioning apparatus 2, the switching mechanism 23 is switched to the air-warming operation state (the state shown by the dashed lines of the switching mechanism 23 in FIG. 9), and the compressor 21 and the heat-source-side fan 25 are driven. In this embodiment, the actions of the components of the refrigerant circuit 10, etc. are the same as the actions of the components of the refrigerant circuit 10 etc. of the first embodiment and are therefore not described here.

In the usage-side air-conditioning apparatuses 3*a*, 3*b* at this time, the second air exhaust blowers 63*a*, 63*b* are stopped, the air exhaust outlet communication mechanisms 65*a*, 65*b* and the air return regulation mechanisms 66*a*, 66*b* are opened, and the second air supply blowers 61*a*, 61*b* are driven. Specifically, the second air supply blowers 61*a*, 61*b* are operated in the outside air intake state. Due to these actions, outdoor air (OA) is taken into the air supply passages 42*a*, 42*b* of the casings 31*a*, 31*b* from outside the air-conditioned spaces S1, S2 through the intake duct 5 (5*a*, 5*b*), and room air (RA) is taken into the air supply passages 42*a*, 42*b* of the casings 31*a*, 31*b* from the air-conditioned spaces S1, S2 through the outtake ducts 7*a*, 7*b*. The outdoor air (OA) and the room air (RA) taken into the casings 31*a*, 31*b* is cooled or heated in the usage-side heat exchangers 33*a*, 33*b* by refrigerant supplied from the heat-source-side air-conditioning apparatus 2 through the liquid refrigerant interconnection pipe 11. Having been cooled or heated in the usage-side heat exchangers 33*a*, 33*b*, the outdoor air (OA) or the outdoor air (OA) including room air (RA) is supplied as supply air (SA) to the air-conditioned spaces S1, S2 through the second air supply blowers 61*a*, 61*b* and the air supply ducts 6*a*, 6*b*. In this embodiment, the opening degrees of the air return regulation mechanisms 66*a*, 66*b* may be adjusted to control the amount of outdoor air (OA) taken in.

<Refrigerant Exhaust Operation>

During the normal operation described above, when refrigerant leaks in the usage-side air-conditioning apparatuses 3*a*, 3*b*, the leaked refrigerant is supplied to the air-conditioned spaces S1, S2, and there is a risk of ignition accidents (when the refrigerant is slightly flammable or flammable) or poisoning accidents (when the refrigerant is toxic) occurring. In view of this, when the refrigerant leakage detection devices 48*a*, 48*b* detect refrigerant, a refrigerant exhaust operation is performed to exhaust refrigerant together with the air in the casings 31*a*, 31*b* out of the air-conditioned spaces S1, S2, by means of the air supply/exhaust mechanisms. In this embodiment, the refrigerant exhaust operation is performed by operating the second air exhaust blowers 63*a*, 63*b* configuring the air supply/exhaust mechanisms in the air exhaust state.

Figure 11:
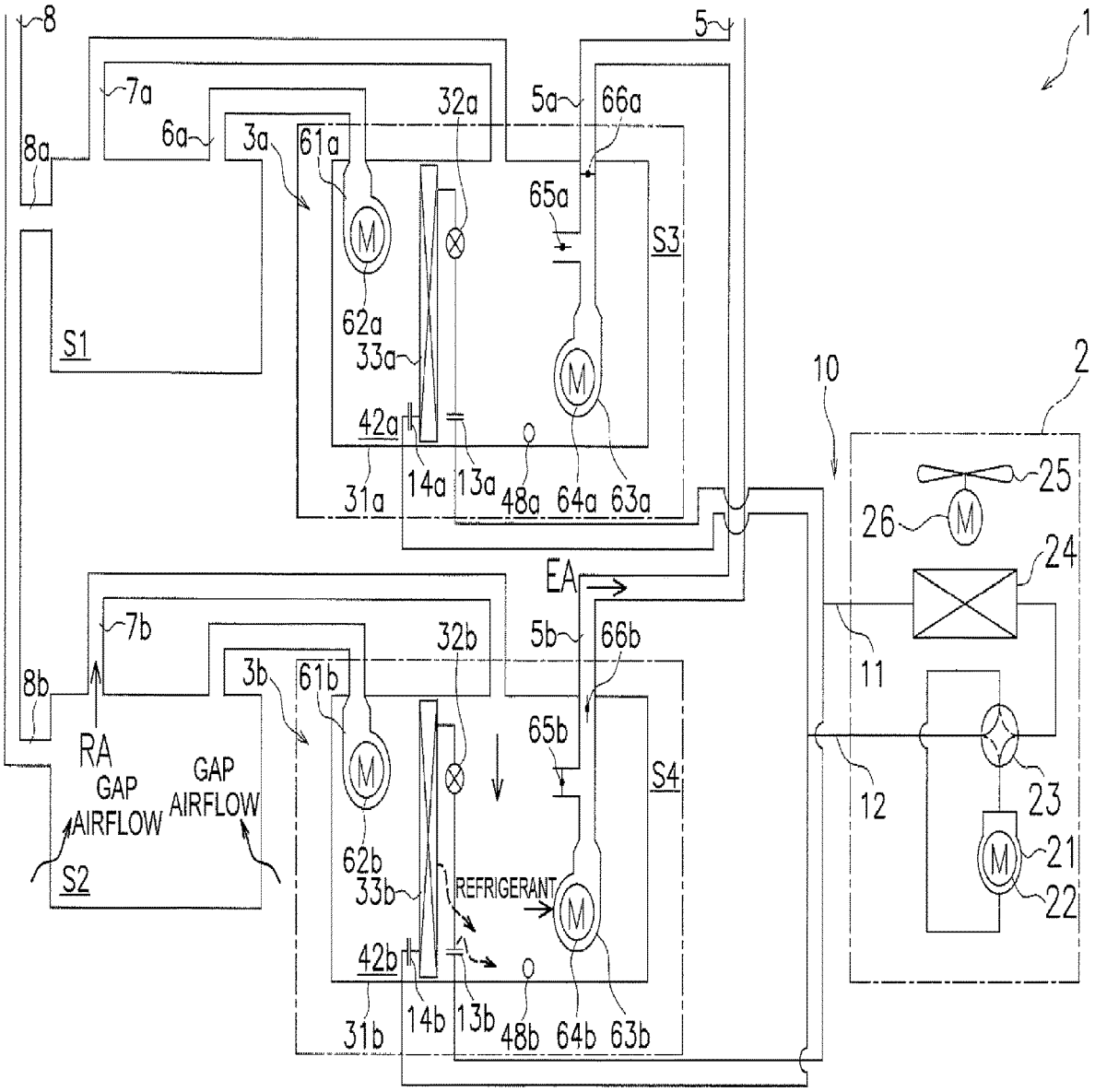
FIG. 11 is a diagram showing air flow during a refrigerant exhaust operation and the like in the third embodiment.

For example, supposing a case in which refrigerant has leaked in the usage-side air-conditioning apparatus 3*b* (i.e., the refrigerant leakage detection device 48*b* has detected refrigerant), the second air exhaust blower 63*b* is operated in the air exhaust state in the usage-side air-conditioning apparatus 3*b* as shown in FIG. 11. Specifically, the air exhaust outlet communication mechanism 65*a* is closed and the second air exhaust blower 63*b* is operated. The leaked refrigerant, along with the air in the casing 31*b*, is thereby exhausted to the intake duct 5 (5*b*). At this time, outdoor air (OA) is taken into the casing 31*b* along with room air (RA), from outside the air-conditioned space S2 through the air exhaust duct 8 (8*b*). The second air supply blower 61*b* is stopped and leaked refrigerant is prevented from being supplied to the air-conditioned space S2. In this embodiment, when the second air exhaust blower 63*b* is operated, room air (RA) is taken into the casing 31*b* from the air-conditioned space S2, and this room air (RA) is exhausted along with the leaked refrigerant to the intake duct 5 (5*b*). In the heat-source-side air-conditioning apparatus 2, refrigerant is prevented from being supplied from the heat-source-side air-conditioning apparatus 2 to the usage-side air-conditioning apparatus 3*b*, for example, due to the compressor 21 being stopped. In the usage-side air-conditioning apparatus 3*a*, in which refrigerant is not leaking, the refrigerant that leaked in the usage-side air-conditioning apparatus 3*b* is prevented from flowing back to the casing 31*a* through the intake duct 5 (5*a*) by closing the air return regulation mechanism 66*a*.

(3) Characteristics

The usage-side air-conditioning apparatuses 3*a*, 3*b* of the present embodiment and the air-conditioning apparatus 1 provided with the same have characteristics such as the following.

In this embodiment, as described above, in the usage-side air-conditioning apparatuses 3*a*, 3*b* having the ventilating air-condition function and the air-conditioning apparatus 1 provided with the same, when the refrigerant leakage detection devices 48*a*, 48*b* detect refrigerant, the refrigerant exhaust operation is performed by the air supply/exhaust mechanisms to exhaust the refrigerant along with the air in the casings 31*a*, 31*b* out of the air-conditioned spaces S1, S2. Particularly, in this embodiment, the refrigerant exhaust operation is performed by operating the second air exhaust blowers 63*a*, 63*b*. Additionally, in this embodiment, the air-conditioning apparatus 1 is configured by connecting the heat-source-side air-conditioning apparatus 2 and the plurality (two in this embodiment) of usage-side air-conditioning apparatuses 3*a*, 3*b*.

In this embodiment, when refrigerant leaks, it is thereby possible to ensure that the leaked refrigerant is quickly exhausted and not supplied to the air-conditioned spaces S1, S2, using the air supply/exhaust mechanisms (in this embodiment, by operating the second air exhaust blowers 63*a*, 63*b*). Additionally, in this embodiment, when refrigerant has leaked in any of the plurality of usage-side air-conditioning apparatuses 3*a*, 3*b*, it is possible to ensure that the leaked refrigerant is quickly exhausted using the air supply/exhaust mechanism of the usage-side air-conditioning apparatus 3*a* or 3*b* in which the refrigerant has leaked, and that the refrigerant is not supplied to the air-conditioned space S1 or S2 that is being air-conditioned by the usage-side air-conditioning apparatus 3*a* or 3*b* in which the refrigerant has leaked.

When the refrigerant is slightly flammable or flammable, the occurrence of ignition accidents in the air-conditioned spaces S1, S2 can be suppressed. When the refrigerant is toxic, the occurrence of poisoning accidents in the air-conditioned spaces S1, S2 can be suppressed. The occurrence of oxygen deficiency accidents in the air-conditioned spaces S1, S2 can be suppressed even when the refrigerant is not slightly flammable, flammable, or toxic.

This embodiment also has the characteristics <B> and <C> of the first embodiment.

(4) Modifications

In the above-described usage-side air-conditioning apparatuses 3*a*, 3*b* and the air-conditioning apparatus 1 provided with the same (see FIGS. 9 to 11), the joints 13*a*, 13*b*, 14*a*, 14*b* connecting the usage-side heat exchangers 33*a*, 33*b* to the refrigerant interconnection pipes are provided inside the casings 31*a*, 31*b*, but there are also cases in which the joints 13*a*, 13*b*, 14*a*, 14*b* are provided outside of the casings 31*a*, 31*b*, similar to the usage-side air-conditioning apparatuses 3*a*, 3*b* of the first embodiment (FIG. 4). In these cases, when refrigerant leaks from the joints 13*a*, 13*b*, 14*a*, 14*b*, the leakage occurs in the usage-side installation spaces S3, S4 in which the casings 31*a*, 31*b* of the usage-side air-conditioning apparatuses 3*a*, 3*b* are installed.

In view of this, in the above-described usage-side air-conditioning apparatuses 3*a*, 3*b* and the air-conditioning apparatus 1 provided with the same (see FIGS. 9 to 11), the usage-side air-conditioning apparatuses 3*a*, 3*b*, similar to the usage-side air-conditioning apparatuses 3*a*, 3*b* according to the modification of the first embodiment, are provided with inside-outside communication mechanisms 47*a*, 47*b*, which are capable of switching between an inside-outside communication state of allowing the usage-side installation spaces S3, S4 and the interiors of the casings 31*a*, 31*b* to communicate, and an inside-outside non-communication state of not allowing the usage-side installation spaces S3, S4 and the interiors of the casings 31*a*, 31*b* to communicate, the refrigerant exhaust operation being performed by putting the inside-outside communication mechanisms 47*a*, 47*b* in the inside-outside communication state.

Fourth Embodiment

(1) Configuration

Figure 12:
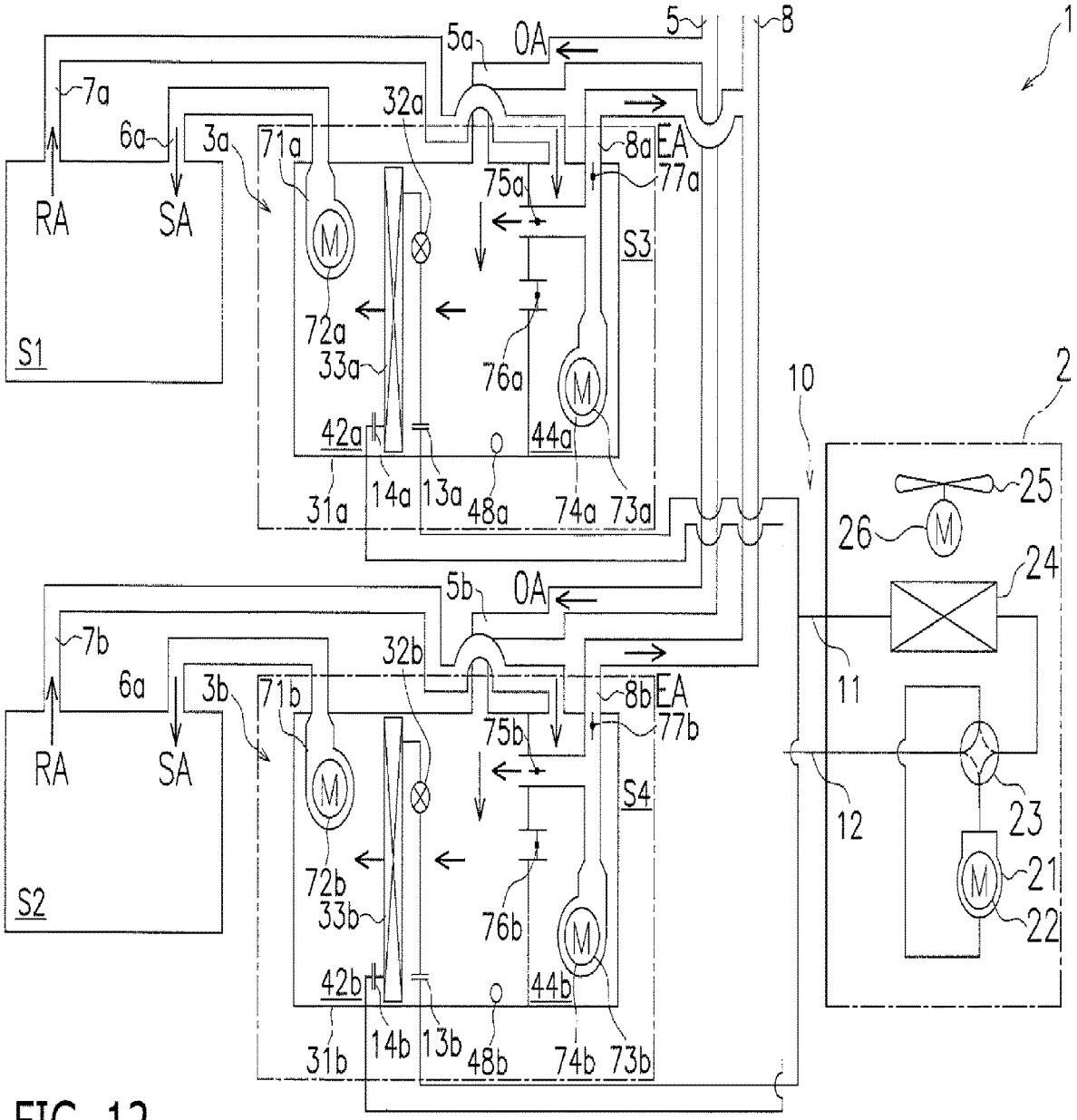
FIG. 12 is an overall configuration diagram of usage-side air-conditioning apparatuses according to a fourth embodiment of the present invention, and an air-conditioning apparatus provided with the same (the flow of air during normal operation and the like are also illustrated)
Figure 13:
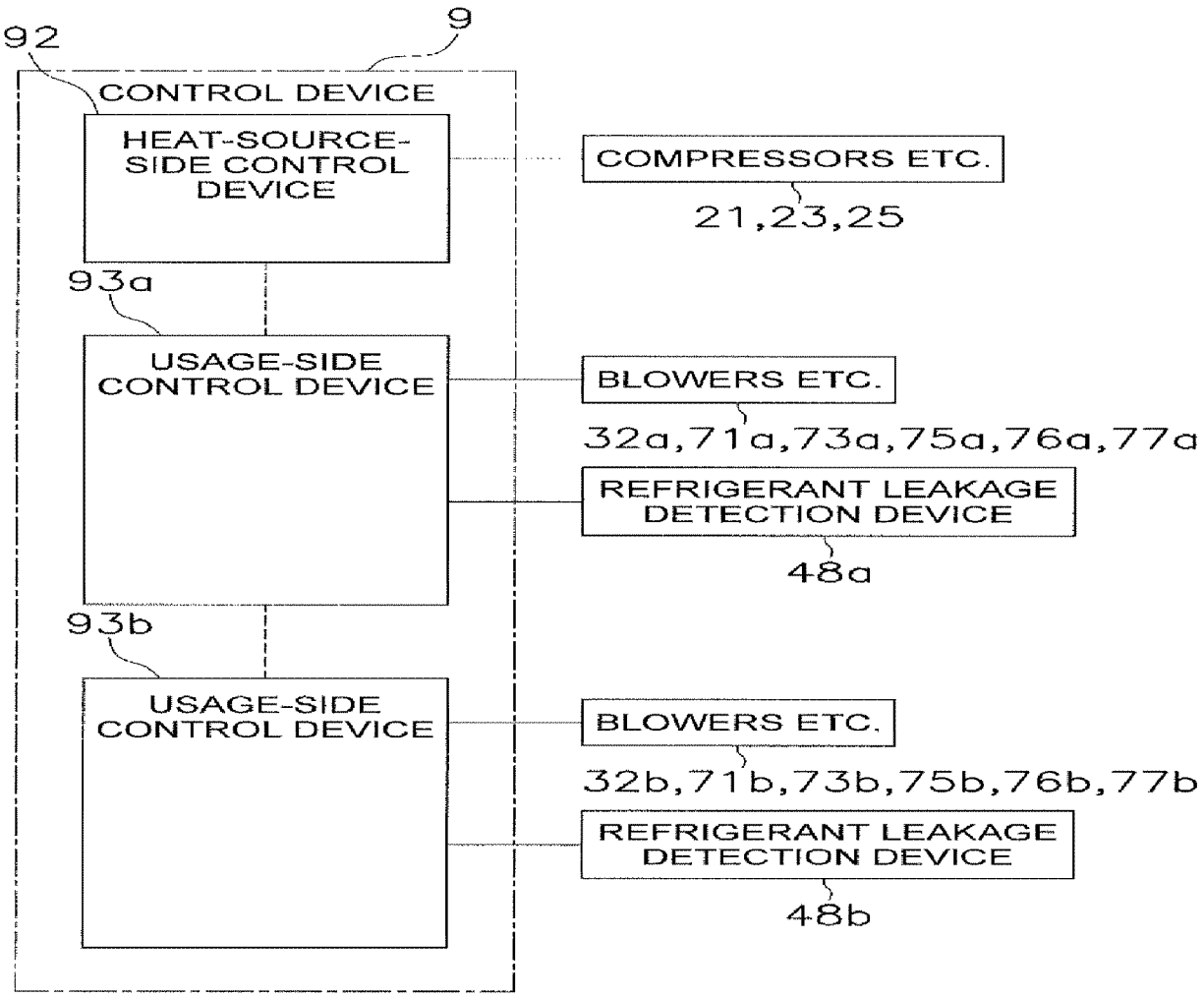
FIG. 13 is a control block diagram of the air-conditioning apparatus in the fourth embodiment.

FIG. 12 is an overall configuration diagram of usage-side air-conditioning apparatuses 3*a*, 3*b* according to a fourth embodiment of the present invention, and an air-conditioning apparatus 1 provided with the same. FIG. 13 is a control block diagram of the air-conditioning apparatus 1 in the fourth embodiment.

<Overall>

The air-conditioning apparatus 1, which is an air-conditioning ventilation system having a ventilating air-condition function for ventilating and air-conditioning the interior of a room, mainly has a heat-source-side air-conditioning apparatus 2, and a plurality (two in this embodiment) of usage-side air-conditioning apparatuses 3*a*, 3*b*.

The air-conditioning apparatus 1 has a refrigerant circuit 10 through which refrigerant circulates. The refrigerant circuit 10 is configured by connecting the heat-source-side air-conditioning apparatus 2 to the usage-side air-conditioning apparatuses 3*a*, 3*b*. In this embodiment, the heat-source-side air-conditioning apparatus 2 is installed in a location such as on the roof of a building, and the usage-side air-conditioning apparatuses 3*a*, 3*b* are installed in usage-side installation spaces (in this embodiment, usage-side installation spaces S3, S4), such as a machine room of the building or a space above the ceiling, in correspondence with air-conditioned spaces (in this embodiment, air-conditioned spaces 51, S2) that are ventilated and air-conditioned. The heat-source-side air-conditioning apparatus 2 and the usage-side air-conditioning apparatuses 3*a*, 3*b* are connected via refrigerant interconnection pipes 11, 12, thereby configuring the refrigerant circuit 10. The refrigerant sealed within the refrigerant circuit 10 is a slightly flammable refrigerant such as R32, a flammable refrigerant such as propane, or a toxic refrigerant such as ammonia.

The air-conditioning apparatus 1 has a plurality of air ducts. In this embodiment, the air-conditioning apparatus 1 has an intake duct 5 for taking outdoor air (OA) into the usage-side air-conditioning apparatuses 3*a*, 3*b* from outside the air-conditioned spaces S1, S2, air supply ducts 6*a*, 6*b* for supplying supply air (SA) from the usage-side air-conditioning apparatuses 3*a*, 3*b* to the air-conditioned spaces S1, S2, outtake ducts 7*a*, 7*b* for taking room air (RA) from the air-conditioned spaces S1, S2 into the corresponding usage-side air-conditioning apparatuses 3*a*, 3*b*, and an air exhaust duct 8 for exhausting exhaust air (EA) from the usage-side air-conditioning apparatuses 3*a*, 3*b* out of the air-conditioned spaces S1, S2 whereby air can be exchanged between the air-conditioned spaces S1, S2 and/or the outsides of the air-conditioned spaces S1, S2 and the usage-side air-conditioning apparatuses 3*a*, 3*b*. The intake duct 5 has intake branch ducts 5*a*, 5*b* that branch corresponding to the usage-side air-conditioning apparatuses 3*a*, 3*b*, and the air exhaust duct 8 has air exhaust branch ducts 8*a*, 8*b* that branch corresponding to the usage-side air-conditioning apparatuses 3*a*, 3*b*.

<Heat-Source-Side Air-Conditioning Apparatus>

The heat-source-side air-conditioning apparatus 2, as described above, is connected to the usage-side air-conditioning apparatuses 3*a*, 3*b* via the refrigerant interconnection pipes 11, 12, configuring part of the refrigerant circuit 10. The configuration of the heat-source-side air-conditioning apparatus 2 according to the present embodiment is similar to the configuration of the heat-source-side air-conditioning apparatus 2 of the first embodiment described above (see FIG. 1), and is therefore not described here.

<Usage-Side Air-Conditioning Apparatuses>

The usage-side air-conditioning apparatuses 3*a*, 3*b*, as described above, are connected to the heat-source-side air-conditioning apparatus 2 via the refrigerant interconnection pipes 11, 12, configuring part of the refrigerant circuit 10. Additionally, the usage-side air-conditioning apparatuses 3*a*, 3*b*, as described above, are designed so as to be able to exchange air with the air-conditioned spaces S1, S2 and/or the outsides of the air-conditioned spaces S1, S2 via the air ducts 5 (5*a*, 5*b*), 6*a*, 6*b*, 7*a*, 7*b*, 8 (8*a*, 8*b*). In the following description, the configuration of the usage-side air-conditioning apparatus 3*a* is described, and description of the configuration of the usage-side air-conditioning apparatus 3*b*, in which the additional letter "a" is replaced by "b" for each component, is omitted.

The usage-side air-conditioning apparatus 3*a* mainly has a casing 31*a*, a usage-side expansion mechanism 32*a*, a usage-side heat exchanger 33*a*, a third air supply blower 71*a*, a third air exhaust blower 73*a*, and a refrigerant leakage detection device 48*a*.

The casing 31*a* is installed in the usage-side installation space S3, and various ducts 5*a*, 6*a*, 7*a*, 8*a* are connected to the casing 31*a*. A space to accommodate the usage-side heat exchanger 33*a* and the like is formed in the casing 31*a*.

The usage-side expansion mechanism 32*a* is an electric expansion valve that can, by performing opening degree control, vary the flow rate of the refrigerant flowing through the usage-side heat exchanger 33*a*. The usage-side expansion mechanism 32*a* is provided inside the casing 31*a*. One end of the usage-side expansion mechanism 32*a* is connected to a liquid side of the usage-side expansion mechanism 32*a*, and another end of the usage-side expansion mechanism 32*a* is connected to the liquid refrigerant interconnection pipe 11 via a joint 13*a*. The joint 13*a* is a pipe joint to connect the usage-side heat exchanger 33*a* to the refrigerant interconnection pipes 11, 12, and in this embodiment, is provided inside the casing 31*a*.

The usage-side heat exchanger 33*a* is a heat exchanger to cool or heat the air (RA and/or OA) in the casing 31*a* by means of the refrigerant supplied from the heat-source-side air-conditioning apparatus 2. The usage-side heat exchanger 33*a* is provided inside the casing 31*a*. The usage-side heat exchanger 33*a* is connected to the heat-source-side air-conditioning apparatus 2 via the refrigerant interconnection pipes 11, 12. A liquid side of the usage-side heat exchanger 33*a* is connected to the liquid refrigerant interconnection pipe 11 via the usage-side expansion mechanism 32*a* and the joint 13*a*, and a gas side of the usage-side heat exchanger 33*a* is connected to the gas refrigerant interconnection pipe 12 via a joint 14*a*. The joint 14*a* is a pipe joint to connect the usage-side heat exchanger 33*a* to the gas refrigerant interconnection pipe 12, and in this embodiment, is provided inside the casing 31*a*. The space inside the casing 31*a* is divided into an air supply passage 42*a* and an air exhaust passage 44*a*. The air supply passage 42*a* communicates with the intake duct 5 (5*a*) and the air supply duct 6*a*, and the air exhaust passage 44*a* communicates with the outtake duct 7*a* and the air exhaust duct 8 (8*a*). The usage-side expansion mechanism 32*a* and the usage-side heat exchanger 33*a* are provided inside the air supply passage 42*a* within the space inside the casing 31*a*, and in this embodiment, the joints 13*a*, 14*a* are also provided inside the air supply passage 42*a*. Therefore, the usage-side heat exchanger 33*a* is designed so as to cool or heat the air inside the air supply passage 42*a*.

The third air supply blower 71*a* is a fan provided to be capable of taking outdoor air (OA) in from outside the air-conditioned space S1 and supplying supply air (SA) to the air-conditioned space S1. The third air supply blower 71*a* is provided inside the air supply passage 42*a*, and an outlet of this blower is connected to the air supply duct 6*a*. The third air supply blower 71*a* is designed to be driven by a third air supply blower motor 72*a*.

The third air exhaust blower 73*a* is a fan provided so as to be capable of taking room air (RA) in from the air-conditioned space S1, returning some of the room air (RA) to the outdoor air (OA) taken in by the third air supply blower 73*a*, and exhaust the remnant of the room air (RA) as exhaust air (EA) out of the air-conditioned space S1. The third air exhaust blower 73*a* is provided inside the air exhaust passage 44*a*, and an outlet of this blower is connected to the air exhaust duct 8 (8*a*). The third air exhaust blower 73*a* is designed to be driven by a third air exhaust blower motor 74*a*. Additionally, an air exhaust outlet communication mechanism 75*a*, which is composed of a communication path to allow communication between the air supply passage 42*a* and the outlet of the third air exhaust blower 73*a* and an air damper placed in this communication path, is provided to the outlet of the third air exhaust blower 73*a*. The air exhaust outlet communication mechanism 75*a* is capable of switching between: a partial exhaust state of allowing the outlet of the third air exhaust blower 73*a* to communicate with the air supply passage 42*a*, returning some of the room air (RA) to the outdoor air (OA) inside the air supply passage 42*a*, and exhausting the remnant of the room air (RA) as exhaust air (EA) out of the air-conditioned space S1, by opening the air damper; and a full exhaust state of not allowing the outlet of the third air exhaust blower 73*a* to communicate with the air supply passage 42*a*, and exhausting all of the room air (RA) as exhaust air (EA) out of the air-conditioned space S1, by closing the air damper. Additionally, an air supply/exhaust communication mechanism 76*a*, composed of a communication path to allow the air supply passage 42*a* and the air exhaust passage 44*a* to communicate and an air damper placed in this communication path, is provided to the casing 31*a*. The air supply/exhaust communication mechanism 76*a* is capable of switching between an air supply-exhaust communication state of allowing the air supply passage 42*a* and the air exhaust passage 44*a* to communicate by opening the air damper, and an air supply-exhaust non-communication state of not allowing the air supply passage 42*a* and the air exhaust passage 44*a* to communicate by closing the air damper. An air return regulation mechanism 77*a* composed of an air damper is provided to an outlet for exhaust air (EA) of the casing 31*a*. The air return regulation mechanism 77*a* may be provided to the air exhaust branch duct 8*a* rather than to the outlet for exhaust air (EA) of the casing 31*a*.

The above-described air passages 42*a*, 44*a*, mechanisms 75*a*, 76*a*, 77*a*, and blowers 71*a*, 73*a*, when connected with the air ducts 5 (5*a*), 6*a*, 6*b*, 7*a*, 7*b*, 8 (8*a*), configure an air supply/exhaust mechanism of the usage-side air-conditioning apparatus 3*a* to take outdoor air (OA) in from outside the air-conditioned space S1, supply the air-conditioned space S1 with supply air (SA), take room air (RA) in from the air-conditioned space S1, return some of the room air (RA) to the outdoor air (OA), and exhaust the remnant of the room air (RA) as exhaust air (EA) out of the air-conditioned space S1.

The refrigerant leakage detection device 48*a* is a device to detect refrigerant. The refrigerant leakage detection device 48*a* is provided inside the casing 31*a*. In this embodiment, the refrigerant leakage detection device 48*a* is provided inside the air supply passage 42*a* in which the usage-side heat exchanger 33*a* (in this embodiment, the joints 13*a*, 14*a* and/or the usage-side expansion mechanism 32*a*) is placed. Furthermore, in this embodiment, the refrigerant leakage detection device 48*a* is provided either to a lower part (when the refrigerant is denser than air) of the casing 31*a* (in this embodiment, the air supply passage 42*a*) or an upper part (when the refrigerant is less dense than air) of the casing 31*a* (in this embodiment, the air supply passage 42*a*). FIG. 12 shows a case in which the refrigerant leakage detection device 48*a* is provided to the lower part of the casing 31*a*.

<Control Device>

The air-conditioning apparatus 1 has a control device 9 to perform operation control on the heat-source-side air-conditioning apparatus 2 and the usage-side air-conditioning apparatuses 3*a*, 3*b* etc. The control device 9 mainly has a heat-source-side control device 92 to control the actions of the components (compressor etc.) configuring the heat-source-side air-conditioning apparatus 2, and usage-side control devices 93*a*, 93*b* to control the actions of the components (fans, refrigerant leakage detection devices, etc.) configuring the usage-side air-conditioning apparatuses 3*a*, 3*b*. The heat-source-side control device 92, which is provided to the heat-source-side air-conditioning apparatus 2, has a microcomputer and/or a memory etc. for performing control on the heat-source-side air-conditioning apparatus 2. The usage-side control devices 93*a*, 93*b*, which are provided to the usage-side air-conditioning apparatuses 3*a*, 3*b*, have microcomputers and/or memories etc. for performing control on the usage-side air-conditioning apparatuses 3*a*, 3*b*. The heat-source-side control device 92 and the usage-side control devices 93*a*, 93*b* are connected so as to be capable of exchanging, for example, control signals via a transmission line, and the control device 9 of the air-conditioning apparatus 1 is thereby configured. In this embodiment, the control devices 92, 93*a*, 93*b* are connected via a transmission line, but are not limited to being connected in this manner and may be connected wirelessly or by another connection method.

(2) Actions

In the air-conditioning apparatus 1 having the configuration described above, the following operations are performed. Operation controls of the air-conditioning apparatus 1 described below are performed by the control device 9.

<Normal Operation>

In normal operation, an operation is performed such that outdoor air (OA) is taken into the casings 31*a*, 31*b* from outside the air-conditioned spaces S1, S2, room air (RA) is taken into the casings 31*a*, 31*b* from the air-conditioned spaces S1, S2 some of the room air (RA) is returned to the outdoor air (OA), the returned air (OA and some of RA) is cooled or heated in the usage-side heat exchangers 33*a*, 33*b* and then supplied as supply air (SA) to the air-conditioned spaces S1, S2, and the remnant of the room air (RA) is exhausted as exhaust air (EA) out of the air-conditioned space S1, as shown in FIG. 12. Specifically, operation control such as the following is performed on the components of the air-conditioning apparatus 1.

When air is supplied as supply air (SA) to the air-conditioned spaces S1, S2 after being cooled in the usage-side heat exchangers 33*a*, 33*b*, in the heat-source-side air-conditioning apparatus 2, the switching mechanism 23 is switched to the air-cooling operation state (the state shown by the solid lines of the switching mechanism 23 in FIG. 12), and the compressor 21 and the heat-source-side fan 25 are driven. When air is supplied as supply air (SA) to the air-conditioned spaces S1, S2 after being heated in the usage-side heat exchangers 33*a*, 33*b*, in the heat-source-side air-conditioning apparatus 2, the switching mechanism 23 is switched to the air-warming operation state (the state shown by the dashed lines of the switching mechanism 23 in FIG. 12), and the compressor 21 and the heat-source-side fan 25 are driven. In this embodiment, the actions of the components of the refrigerant circuit 10 etc. are the same as the actions of the components of the refrigerant circuit 10, etc. of the first embodiment and are therefore not described here.

In the usage-side air-conditioning apparatuses 3*a*, 3*b* at this time, the air exhaust outlet communication mechanisms 75*a*, 75*b* and the air return regulation mechanisms 77*a*, 77*b* are opened, the air supply/exhaust communication mechanism 76*a* is closed, and the third air supply blowers 71*a*, 71*b* and the third air exhaust blowers 73*a*, 73*b* are driven. Due to these actions, outdoor air (OA) is taken into the air supply passages 42*a*, 42*b* of the casings 31*a*, 31*b* from outside the air-conditioned spaces S1, S2 through the intake duct 5 (5*a*, 5*b*), and room air (RA) is taken into the air exhaust passages 44*a*, 44*b* of the casings 31*a*, 31*b* from the air-conditioned spaces S1, S2 through the outtake ducts 7*a*, 7*b*. The room air (RA) taken into the casings 31*a*, 31*b* is sent by the third air exhaust blowers 73*a*, 73*b* to the outlets thereof. Some of the room air (RA) sent to the outlets of the third air exhaust blowers 73*a*, 73*b* is sent through the air exhaust outlet communication mechanisms 75*a*, 75*b* to the air supply passage 42*a* to merge with the outdoor air (OA) in accordance with the opening degrees of the air dampers of the air return regulation mechanisms 77*a*, 77*b*, and the remnant of the room air (RA) is exhausted as exhaust air (EA) out of the air-conditioned spaces S1, S2 through the air exhaust duct 8 (8*a*, 8*b*). With the merged room air (RA), the outdoor air (OA) is cooled or heated in the usage-side heat exchangers 33*a*, 33*b* by refrigerant supplied from the heat-source-side air-conditioning apparatus 2 through the liquid refrigerant interconnection pipe 11. Having been cooled or heated in the usage-side heat exchangers 33*a*, 33*b*, the outdoor air (OA) including room air (RA) is supplied as supply air (SA) to the air-conditioned spaces 51, S2 through the third air supply blowers 71*a*, 71*b* and the air supply ducts 6*a*, 6*b*.

<Refrigerant Exhaust Operation>

During the normal operation described above, when refrigerant leaks in the usage-side air-conditioning apparatuses 3*a*, 3*b*, the leaked refrigerant is supplied to the air-conditioned spaces 51, S2, and there is a risk of ignition accidents (when the refrigerant is slightly flammable or flammable) or poisoning accidents (when the refrigerant is toxic) occurring. In view of this, when the refrigerant leakage detection devices 48*a*, 48*b* detect refrigerant, a refrigerant exhaust operation is performed to exhaust refrigerant together with the air in the casings 31*a*, 31*b* out of the air-conditioned spaces 51, S2, by means of the air supply/exhaust mechanisms. In this embodiment, the refrigerant exhaust operation is performed by operating the third air exhaust blowers 73*a*, 73*b* configuring the air supply/exhaust mechanisms.

Figure 14:
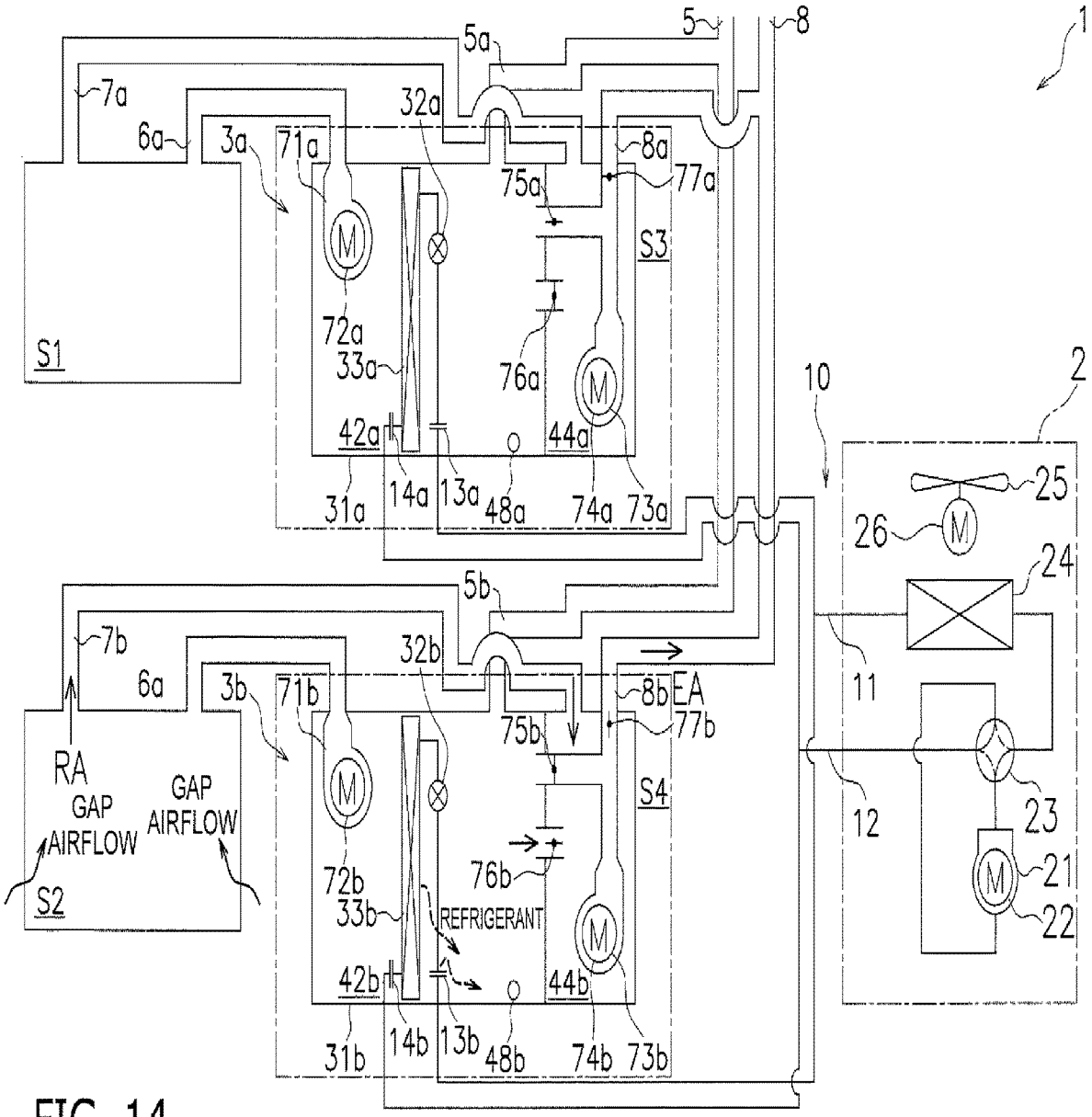
FIG. 14 is a diagram showing air flow during a refrigerant exhaust operation and the like in the fourth embodiment.

For example, supposing a case in which refrigerant has leaked in the usage-side air-conditioning apparatus 3*b* (i.e., the refrigerant leakage detection device 48*b* has detected refrigerant), the third air exhaust blower 73*b* is operated in the usage-side air-conditioning apparatus 3*b* as shown in FIG. 14. Specifically, the air exhaust outlet communication mechanism 75*b* is closed, the air supply/exhaust communication mechanism 76*b* is opened, and the third air exhaust blower 73*b* is operated. The leaked refrigerant, along with the air in the casing 31*b*, is thereby exhausted to the air exhaust duct 8 (8*b*) through the air supply passage 42*b* and the air exhaust passage 44*b*. The third air supply blower 71*b* is stopped and leaked refrigerant is prevented from being supplied to the air-conditioned space S2. In this embodiment, when the third air exhaust blower 73*b* is operated, room air (RA) is taken into the casing 31*b* from the air-conditioned space S2, and this room air (RA) is exhausted along with the leaked refrigerant to the air exhaust duct 8 (8*b*). In the heat-source-side air-conditioning apparatus 2, refrigerant is prevented from being supplied from the heat-source-side air-conditioning apparatus 2 to the usage-side air-conditioning apparatus 3*b*, for example, due to the compressor 21 being stopped. In the usage-side air-conditioning apparatus 3*a*, in which refrigerant is not leaking, the refrigerant that leaked in the usage-side air-conditioning apparatus 3*b* is prevented from flowing back to the casing 31*a* through the air exhaust duct 8 (8*a*) by closing the air return regulation mechanism 77*a*.

(3) Characteristics

The usage-side air-conditioning apparatuses 3*a*, 3*b* of the present embodiment and the air-conditioning apparatus 1 provided with the same have characteristics such as the following.

In this embodiment, as described above, in the usage-side air-conditioning apparatuses 3*a*, 3*b* having the ventilating air-condition function and the air-conditioning apparatus 1 provided with the same, when the refrigerant leakage detection devices 48*a*, 48*b* detect refrigerant, the refrigerant exhaust operation is performed by the air supply/exhaust mechanisms to exhaust the refrigerant along with the air in the casings 31*a*, 31*b* out of the air-conditioned spaces S1, S2. Particularly, in this embodiment, the refrigerant exhaust operation is performed by operating the third air exhaust blowers 73*a*, 73*b*. Additionally, in this embodiment, the air-conditioning apparatus 1 is configured by connecting the heat-source-side air-conditioning apparatus 2 and the plurality (two in this embodiment) of usage-side air-conditioning apparatuses 3*a*, 3*b*.

In this embodiment, when refrigerant leaks, it is thereby possible to ensure that the leaked refrigerant is quickly exhausted and not supplied to the air-conditioned spaces S1, S2, using the air supply/exhaust mechanisms (in this embodiment, by operating the third air exhaust blowers 73*a*, 73*b*). Additionally, in this embodiment, when refrigerant has leaked in any of the plurality of usage-side air-conditioning apparatuses 3*a*, 3*b*, it is possible to ensure that the leaked refrigerant is quickly exhausted using the air supply/exhaust mechanism of the usage-side air-conditioning apparatus 3*a* or 3*b* in which the refrigerant has leaked, and that the refrigerant is not supplied to the air-conditioned space S1 or S2 that is being air-conditioned by the usage-side air-conditioning apparatus 3*a* or 3*b* in which the refrigerant has leaked.

When the refrigerant is slightly flammable or flammable, the occurrence of ignition accidents in the air-conditioned spaces S1, S2 can be suppressed. When the refrigerant is toxic, the occurrence of poisoning accidents in the air-conditioned spaces S1, S2 can be suppressed. The occurrence of oxygen deficiency accidents in the air-conditioned spaces S1, S2 can be suppressed even when the refrigerant is not slightly flammable, flammable, or toxic.

This embodiment also has the characteristics <B> and <C> of the first embodiment.

(4) Modifications

In the above-described usage-side air-conditioning apparatuses 3*a*, 3*b* and the air-conditioning apparatus 1 provided with the same (see FIGS. 12 to 14), the joints 13*a*, 13*b*, 14*a*, 14*b* connecting the usage-side heat exchangers 33*a*, 33*b* to the refrigerant interconnection pipes are provided inside the casings 31*a*, 31*b*, but there are also cases in which the joints 13*a*, 13*b*, 14*a*, 14*b* are provided outside of the casings 31*a*, 31*b*, similar to the usage-side air-conditioning apparatuses 3*a*, 3*b* of the first embodiment (FIG. 4). In these cases, when refrigerant leaks from the joints 13*a*, 13*b*, 14*a*, 14*b*, the leakage occurs in the usage-side installation spaces S3, S4 in which the casings 31*a*, 31*b* of the usage-side air-conditioning apparatuses 3*a*, 3*b* are installed.

In view of this, in the above-described usage-side air-conditioning apparatuses 3*a*, 3*b* and the air-conditioning apparatus 1 provided with the same (see FIGS. 12 to 14), the usage-side air-conditioning apparatuses 3*a*, 3*b*, similar to the usage-side air-conditioning apparatuses 3*a*, 3*b* according to the modification of the first embodiment, are provided with inside-outside communication mechanisms 47*a*, 47*b*, which are capable of switching between an inside-outside communication state of allowing the usage-side installation spaces S3, S4 and the interiors of the casings 31*a*, 31*b* to communicate, and an inside-outside non-communication state of not allowing the usage-side installation spaces S3, S4 and the interiors of the casings 31*a*, 31*b* to communicate, the refrigerant exhaust operation being performed by putting the inside-outside communication mechanisms 47*a*, 47*b* in the inside-outside communication state.

INDUSTRIAL APPLICABILITY

The present invention is widely applicable to: usage-side air-conditioning apparatuses that have usage-side heat exchangers to cool or heat air inside casings by means of refrigerant supplied from a heat-source-side air-conditioning apparatus, and air supply/exhaust mechanisms to take air into the casings from air-conditioned spaces or outside air-conditioned spaces and to supply the air inside the casings to the air-conditioned spaces or to the outsides of the air-conditioned spaces; and air-conditioning apparatuses that are provided with such usage-side air-conditioning apparatuses.

REFERENCE SIGNS LIST

1 Air-conditioning apparatus
2 Heat-source-side air-conditioning apparatus
3*a*, 3*b* Usage-side air-conditioning apparatuses
11, 12 Refrigerant interconnection pipes
13*a*, 13*b*, 14*a*, 14*b* Joints
31*a*, 31*b* Casings
33*a*, 33*b* Usage-side heat exchangers
35*a*, 35*b* First air supply blowers
37*a*, 37*b* First air exhaust blowers
47*a*, 47*b* Inside-outside communication mechanisms
48*a*, 48*b*, 49*a*, 49*b* Refrigerant leakage detection devices
51*a*, 51*b* Air supply/exhaust blowers
61*a*, 61*b* Second air supply blowers
63*a*, 63*b* Second air exhaust blowers
71*a*, 71*b* Third air supply blowers
73*a*, 73*b* Third air exhaust blowers

CITATION LIST

Patent Literature

Patent Literature 1: Japanese Laid-open Patent Publication No. 2000-220877

The invention claimed is:

1. An air-conditioning apparatus configured by connecting a heat-source-side air-conditioning apparatus, including a compressor and heat-source-side heat exchanger, to supply refrigerant;

a plurality of usage-side air-conditioning apparatuses, each of the plurality of usage-side air-conditioning apparatuses including a casing;

a usage-side heat exchanger, being provided inside the casing, to cool or heat air inside the casing through the use of a refrigerant supplied from the heat-source-side air-conditioning apparatus; and an air supply/exhaust mechanism, including at least one air blower and an air return regulation mechanism including at least one air damper, to take room air into the casing from an air-conditioned space, take outdoor air into the casing from outside the air-conditioned space, supply the air inside the casing as supply air to the air-conditioned space, and exhaust the air inside the casing as exhaust air out of the air-conditioned space;

a duct connecting between outside of the air-conditioned spaces and the plurality of usage-side air-conditioning apparatuses, the duct having a plurality of branch ducts, each of the plurality of branch ducts branches to a corresponding one of the plurality of usage-side air-conditioning apparatuses; and a controller configured to perform a refrigerant exhaust operation when a refrigerant leakage is detected in a respective casing of one or more of the plurality of usage-side air-conditioning apparatuses by controlling the air supply/exhaust mechanisms of the plurality of usage-side air-conditioning apparatuses to exhaust the refrigerant out of the air-conditioned space along with the air inside the respective casing via the branch duct of the one or more of the plurality of usage-side air-conditioning apparatuses having the detected leakage.

2. The air conditioning apparatus according to claim 1, wherein each of the plurality of usage-side air-conditioning apparatuses further includes a total heat exchanger to perform heat exchange between the outdoor air and the room air is provided inside the casing;

the air supply/exhaust mechanism further includes an air supply blower provided so as to be able to take the outdoor air in from outside the air-conditioned space and supply the supply air to the air-conditioned space, and an air exhaust blower provided so as to be able to take the room air in from the air-conditioned space and exhaust the exhaust air out of the air-conditioned space; and the controller is further configured to perform the refrigerant exhaust operation by controlling operation of the air exhaust blower of the one or more of the plurality of usage-side air-conditioning apparatuses having the detected leakage.

3. The air conditioning apparatus according to claim 1, wherein the air supply/exhaust mechanism further includes an air supply/exhaust blower provided to be capable of switching between an air supply state of taking the room air in from the air-conditioned space, taking the outdoor air in from outside the air-conditioned space, and supplying the supply air to the air-conditioned space, and an air exhaust state of exhausting the exhaust air out of the air-conditioned space; and the controller is further configured to perform the refrigerant exhaust operation by controlling the air supply/exhaust blower of the one or more of the plurality of usage-side air-conditioning apparatuses having the detected leakage to operate in the air exhaust state.

4. The air conditioning apparatus according to claim 1, wherein the air supply/exhaust mechanism has an air supply blower provided so as to be capable of taking the room air in from the air-conditioned space, taking the outdoor air in from outside the air-conditioned space, and supplying the supply air to the air-conditioned space, and an air exhaust blower provided so as to be capable of exhausting the exhaust air out of the air-conditioned space; and the controller is further configured to perform the refrigerant exhaust operation by controlling operation of the air exhaust blower of the one or more of the plurality of usage-side air-conditioning apparatuses having the detected leakage.

5. The air conditioning apparatus according to claim 1, wherein the air supply/exhaust mechanism further includes an air supply blower provided so as to be capable of taking the outdoor air in from outside the air-conditioned space and supplying the supply air to the air-conditioned space, and an air exhaust blower provided so as to be capable of taking the room air in from the air-conditioned space, returning some of the room air to the outdoor air taken in by the third air supply blower, and exhausting a remnant of the room air as the exhaust air out of the air-conditioned space; and the controller is further configured to perform the refrigerant exhaust operation by controlling operation of the air exhaust blower of the one or more of the plurality of usage-side air-conditioning apparatuses having the detected leakage.

6. The air conditioning apparatus according to claim 1, wherein the usage-side heat exchanger of each of the plurality of usage-side air-conditioning apparatuses is connected to the heat-source-side air-conditioning apparatus via a refrigerant interconnection pipe; and a joint to connect the usage-side heat exchanger to the refrigerant interconnection pipe is provided inside the casing of each of the plurality of usage-side air-conditioning apparatuses.

7. The air conditioning apparatus according to claim 1, wherein the usage-side heat exchanger of each of the plurality of usage-side air-conditioning apparatuses is connected to the heat-source-side air-conditioning apparatus via a refrigerant interconnection pipe;

a joint to connect the usage-side heat exchanger to the refrigerant interconnection pipe is provided outside the casing of each of the plurality of usage-side air-conditioning apparatuses in a usage-side installation space in which the casing is provided;

each of the plurality of usage-side air-conditioning apparatuses further includes a communication passage between the air supply passage of the casing and the installation space and the at least one air damper of the air return regulation mechanism is capable of switching between an inside-outside communication state of allowing communication between the air supply passage of an interior of the casing and the usage-side installation space, and an inside-outside non-communication state of not allowing communication between the air supply passage of the casing interior and the usage-side installation space; and the controller is further configured to, during the refrigerant exhaust operation, put the at least one damper of the one or more of the plurality of usage-side air-conditioning apparatuses having the detected leakage in the inside-outside communication state.

8. The air conditioning apparatus according to claim 1, wherein the refrigerant is denser than air.

9. The air conditioning apparatus according to claim 7, wherein the controller is further configured to, during the refrigerant exhaust operation, put the at least one damper blower of the plurality of usage-side air-conditioning apparatuses in which a refrigerant leakage is not detected in the inside-outside non-communication state.

* * * * *